US007871966B2

(12) United States Patent
Matsui

(10) Patent No.: US 7,871,966 B2
(45) Date of Patent: Jan. 18, 2011

(54) LUBRICATING OIL COMPOSITION

(75) Inventor: Shigeki Matsui, Kanagawa (JP)

(73) Assignee: Nippon Oil Corporation, Tokyo (JP)

( * ) Notice: Subject to any disclaimer, the term of this patent is extended or adjusted under 35 U.S.C. 154(b) by 317 days.

(21) Appl. No.: 12/050,476

(22) Filed: Mar. 18, 2008

(65) Prior Publication Data

US 2008/0234153 A1 Sep. 25, 2008

(30) Foreign Application Priority Data

Mar. 19, 2007 (JP) ..... 2007-070414
Mar. 19, 2007 (JP) ..... 2007-070419

(51) Int. Cl.
*C10L 1/22* (2006.01)
*C10M 135/18* (2006.01)
*C10M 137/10* (2006.01)

(52) U.S. Cl. ..... 508/192; 508/363; 508/369

(58) Field of Classification Search ..... 508/192, 508/363, 369
See application file for complete search history.

(56) References Cited

U.S. PATENT DOCUMENTS 6,004,910 A * 12/1999 Bloch et al. ..... 508/294
6,703,353 B1 * 3/2004 Lok et al. ..... 508/110

FOREIGN PATENT DOCUMENTS

JP 01-48319 10/1989
JP 03-3595 3/1991
JP 03-23595 3/1991
JP 05-83599 11/1993
JP 06-62983 8/1994
JP 2000-256690 9/2000
JP 2001-279287 10/2001
JP 2004-010799 1/2004
JP 3662228 6/2005
JP 3709379 10/2005
JP 3738228 1/2006

* cited by examiner

*Primary Examiner*—Walter D Griffin
*Assistant Examiner*—Frank C Campanell
(74) *Attorney, Agent, or Firm*—Ladas & Parry LLP

(57) ABSTRACT

The present invention provides a lubricating oil composition, which is capable to maintain sufficient low-friction (i.e. fuel saving performance) even when the lubricating oil is contaminated with soot and metal abrasion powder, which is excellent in durability with regard to anti-wear property and detergency, as well as oxidation stability, and which is capable to lower the ash content and to sufficiently maintain the performance of exhaust-gas after-treatment device for a long term. The lubricating oil composition comprises a lubricant base oil containing a base oil (X) of which % $C_P$ is 70 or more, % $C_A$ is 1 or less, viscosity index is 115 or more, and CCS viscosity at −35° C. is 3000 mPa·s or less, wherein the lubricant base oil, to total mass of the composition, contains following components (A)~(D):

(A) 0.01~10 mass % of ashless friction modifier;
(B) 0.01~0.2 mass % of phosphorus-containing anti-wear agent as phosphorous content;
(C) 0.01~1 mass % of metallic detergent as metal content; and
(D) 0.01~0.4 mass % of ashless dispersant having 3000~20000 of weight-average molecular weight as nitrogen content.

9 Claims, No Drawings

LUBRICATING OIL COMPOSITION

TECHNICAL FIELD

The present invention relates to a lubricating oil composition. More specifically, it relates to a lubricating oil composition which is suitable as lubricating oil for internal combustion engine, particularly diesel engine and direct-injection gasoline engine.

BACKGROUND ART

In general, in mechanical systems having sliding portion, i.e. internal combustion engine, automatic transmission, damper, drive-train module such as power steering, gears, and so on, lubricating oil is used to lubricate the motions. Particularly, lubricating oil for internal combustion engine mainly lubricates piston ring and cylinder liner, bearings of crankshaft, connecting rods, valve train, but also works as coolant or detergent-and-dispersant of combustion product in the engine, further works as rust and corrosion inhibitor.

Hence, the lubricating oil for internal combustion engine is required various functions; in addition to this, in recent years, trade-off functions of lubricating oil, such as: improvement of fuel saving; minimization of ash-content, phosphorus-content, and sulfur-content to minimize the effect on exhaust-gas after-treatment device; improvement of long-drain performance; and so on, are also required at high degree of compatibility. In internal combustion engine, since energy loss at friction parts where the lubricating oil is involved with is large, in order to reduce friction loss and fuel consumption, for example, as disclosed in Patent Document 1, lubricating oil which is a combination of friction reducer and other various additives is used.

Conventionally, so as to lower friction coefficient of the lubricating oil, addition of organomolybdenum compound represented by molybdenum dithiocarbamate and molybdenum dithiophosphate has been carried out. In addition to this, blending of the organomolybdenum compound and metallic detergent (See e.g., Patent Document 2.), or blending of the organomolybdenum compound and sulfur compound (See e.g., Patent Document 3.) have also been carried out.

However, in diesel engine and direct-injection gasoline engine, large amount of soot produced within piston is mixed into the engine oil. This soot absorbs polar additive in the oil as it has surface activity, and it also scrapes off a coating formed on the friction surface. Thereby, under such a severe friction condition, even if the organomolybdenum compound which is supposed to be the most effective substance for reducing friction is used, sufficient friction reducing effect cannot be obtained because of the inhibition by the soot and abrasion powder of metal. Few studies to overcome this problem have been made; the only suggestion is to mix alkali metal borate salt hydrate (See e.g., Patent Document 4.) and the like for improving fuel saving performance of diesel engine.

On the other hand, lowering viscosity of lubricating oil is also known as an effective measure to improve fuel saving performance, and multigrade diesel engine oil, which is obtained by adding viscosity index improver like polymethacrylate and ethylene-propylene copolymer to low-viscosity lubricating oil, is generally used. Nevertheless, fuel saving effect of the multigrade diesel engine oil in which the above viscosity index improver is only added is little and it is far from sufficient. So, in the field of diesel engine and direct-injection gasoline engine, technical development of engine oil which enables to sufficiently attain the fuel saving effect has been required.

As for diesel engine, reduction of $NO_X$ and particulate matters (SPM) is an urgent need, in order to reduce the exhaust gas, introduction of means for reducing exhaust gas, for instance, high-pressure injection, Exhaust Gas Recirculation system (EGR), oxidation catalyst, Diesel Particulate Filter (DPF), or $NO_X$ storage reduction catalyst, are considered.

However, among the means for reducing exhaust gas, when particularly oxidation catalyst of exhaust-gas after-treatment device, $NO_x$ storage reduction catalyst, and DPF are used, it is known that life-time thereof is shortened by engine oil to be used depending on the composition. For example, when a lubricating oil containing zinc dialkyl dithiophosphate (hereinafter, refer to as "ZnDTP".) which is effective as an anti-wear agent or an antioxidant (peroxide decomposer) is used, zinc atom in ZnDTP forms oxide, phosphate, sulfate, or the like during the combustion process; these substances are deposited on the catalytic surface or in the filter, and there is a possibility of spoiling detergent performance of the above exhaust-gas aftertreatment devices. As the countermeasure against this, it is preferable not to add ZnDTP to the lubricating oil for engine equipped with the above exhaust-gas after-treatment devices, or preferable to add the same as little as possible. Further, metallic detergent and sulfur content also tend to cause the above-mentioned problem since these are formed into metal oxide and sulfate and deposited as ash in the filters and the like, it is desirable to minimize the content thereof.

Moreover, because of the large amount of soot being mixed into the lubricating oil, there is a concern that diesel engine, specifically an EGR-equipped diesel engine might have increase of wear in valve train system and the like and deterioration of high-temperature detergency like piston detergency are worried about. Furthermore, there is another concern that direct-injection gasoline engine might have negative effect similar to the above by the soot being mixed into the lubricating oil and have combustion chamber deposit and valve deposit. Hence, simply reducing the content of ZnDTP, metallic detergent, and sulfur content is extremely difficult, it is necessary to consider a new means for make-up reduced detergency and anti-wear property involved in the reduction of these contents.

As a lubricating oil composition for engine equipped with an exhaust-gas after-treatment device, a diesel engine oil composition which minimize the sulfated ash content down to 0.7 mass % or less is proposed (See Patent Document 5.). Further, so as to improve detergency and anti-wear property under a condition of soot contamination, engine oil containing dispersant-type viscosity index improver is also proposed (See Patent Documents 6 and 7.). However, in these proposals, high-temperature detergency and property of base-number retention are not necessarily sufficient when metallic detergent is reduced; high-temperature detergency in case of reducing ZnDTP content and anti-wear property under a condition of soot contamination are not sufficiently considered. Accordingly, in order to maintain or improve the level of high-temperature detergency and property of base-number retention high and to inhibit soot-derived wear which is unignorable when ZnDTP content is reduced, furthermore research and development are required.

As a method for significantly enhancing high-temperature detergency, property of base-number retention and low friction of lubricating oil, lubricating oil composition obtained by blending a salicylate detergent of which ZnDTP content is reduced and of which the metal ratio is prepared to become 2.6 or less or salicylate detergent of which metal ratio is less than 2 with over-based sulfonate is commonly known. Nevertheless, anti-wear property under the condition of soot mixing is not necessarily sufficient, improvement of such a problem is required (See Patent Documents 8~10.).

Therefore, in order to maintain or improve the level of high-temperature detergency and property of base-number retention high and to inhibit soot-derived wear which is unignorable when ZnDTP content is reduced, furthermore research and development are required.

Patent Document 1: Japanese Patent Application Examined No. 03-23595

Patent Document 2: Japanese Patent Application Examined No. 06-62983

Patent Document 3: Japanese Patent Application Examined No. 05-83599

Patent Document 4: Japanese Patent Application Examined No. 01-48319

Patent Document 5: Japanese Patent Application Laid-Open (JP-A) No. 2000-256690

Patent Document 6: JP-A No. 2001-279287

Patent Document 7: JP-A No. 2004-10799

Patent Document 8: Japanese Patent No. 3662228

Patent Document 9: Japanese Patent No. 3709379

Patent Document 10: Japanese Patent No. 3738228

DISCLOSURE OF THE INVENTION

Problems to be Solved by the Invention

A problem to be solved by the first aspect of the present invention is to provide a lubricating oil composition which is capable to maintain sufficient low-friction (i.e. fuel saving performance) even when the lubricating oil is contaminated with soot and metal abrasion powder, which is excellent in durability with regard to anti-wear property and detergency as well as oxidation stability, and which is capable to lower the production of ash and to sufficiently maintain the performance of exhaust-gas after-treatment device for a long term.

Another problem to be solved by the second aspect of the present invention is to provide a lubricating oil composition which is excellent in anti-wear property even when the lubricating oil is contaminated with soot and metal abrasion powder, and which is capable to sufficiently maintain the performance of exhaust-gas after-treatment device for a long term.

Means for Solving the Problems

The present inventors have been conducted serious studies in order to solve the above problems. As a result, the present inventors have acquired an idea that a lubricating oil composition containing specific lubricant base oil and specific additives can solve the above problems; thereby the following invention is completed.

The first aspect of the present invention is a lubricating oil composition comprising a lubricant base oil containing a base oil (X) of which % $C_P$ is 70 or more, % $C_A$ is 1 or less, viscosity index is 115 or more, and CCS viscosity at −35° C. is 3000 mPa·s or less, wherein the lubricant base oil, to total mass of the composition, contains following components (A)~(D):

(A) 0.01~10 mass % of ashless friction modifier;

(B) 0.01~0.2 mass % of phosphorus-containing anti-wear agent as phosphorous content;

(C) 0.01~1 mass % of metallic detergent as metal content; and (D) 0.01~0.4 mass % of ashless dispersant having 3000~20000 of weight-average molecular weight as nitrogen content.

According to the first aspect of the invention, the lubricating oil composition shows significantly excellent viscosity-temperature characteristic and frictional property, and is capable to achieve excellent low-friction and anti-wear property when soot is mixed; since it is capable to reduce ash, it is also possible to sufficiently maintain the performance of exhaust-gas after-treatment device for a long term.

In the first aspect of the invention, (A) component preferably a compound containing at least three atoms or more of one or more elements selected from a group consisting of nitrogen, oxygen, and sulfur. Because of this, even when phosphorus-containing anti-wear agent, particularly ZnDTP is reduced or is not used, it is capable to significantly lower the wear and friction under a condition of soot contamination. Thereby, it is possible to reduce phosphorus and to sufficiently maintain the performance of exhaust-gas after-treatment device for a long term.

In the lubricating oil composition of the first aspect of the invention, 0.001~0.2 mass % of organomolybdenum compound (E2) other than molybdenum dithiocarbamate and molybdenum dithiophosphate, to total mass of composition, is preferably contained as molybdenum content. Because of this, it is capable to obtain a composition which is specifically excellent in high-temperature detergency.

The second aspect of the present invention is a lubricating oil composition comprising a lubricant base oil containing a base oil (X) of which % $C_P$ is 70 or more, % $C_A$ is 1 or less, viscosity index is 115 or more, and CCS viscosity at −35° C. is 3000 mPa·s or less, wherein the lubricant base oil, to total mass of the composition, contains following components (A)~(D):

(A1) 0.005~0.2 mass % of at least one of molybdenum friction modifier selected from molybdenum dithiophosphate and molybdenum dithiocarbamate as molybdenum content;

(B) 0.01~0.2 mass % of phosphorus-containing anti-wear agent as phosphorous content;

(C') 0.01~1 mass % of metallic detergent which at least contains (C1) sulfonate detergent and of which metal ratio is prepared to become 3.0 or more as metal content; and (D) 0.01~0.4 mass % of ashless dispersant having 3000~20000 of weight-average molecular weight as nitrogen content.

According to the second aspect of the invention, since the lubricating oil composition shows significantly excellent viscosity-temperature characteristic and frictional property, and is capable to achieve excellent low-friction and anti-wear property when soot is mixed; since it is capable to reduce ash, it is possible to sufficiently maintain the performance of exhaust-gas after-treatment device for a long term.

In the second aspect of the invention, the (C') component preferably contains: (C1a) sulfonate detergent of which metal ratio is less than 2 and/or (C2a) phenate detergent of which metal ratio is less than 2; and (C1b) sulfonate detergent of which metal ratio is 6.0 or more. Because of this, the lubricating oil composition is capable to achieve more excellent anti-wear property and to sufficiently maintain the performance of exhaust-gas after-treatment device for a long term.

In the first and second aspects of the invention, the kinematic viscosity of said base oil (X) at 100° C. is preferably 3.5 $mm^2/s$ or more and the CCS viscosity of said base oil (X) at −35° C. is preferably 2000 mPa·s or less. By having the above condition, it is capable to obtain a lubricating oil composition which is furthermore excellent in lubricity and fuel saving performance at a time of low-temperature starting.

In the first and second aspects of the invention, the lubricant base oil preferably further contains base oil (Ya) of which CCS viscosity at −35° C. is over 3000 mPa·s, viscosity index is 80 or more, % $C_P$ is 60 or more, % $C_A$ is 10 or less, and kinematic viscosity at 100° C. is 5 $mm^2/s$ or more. Accordingly, it is capable to obtain a lubricating oil composition which is possible to reduce wear under a condition of soot contamination.

In the first and second aspects of the invention, the (D) component preferably contains (D1) ashless dispersant of which weight-average molecular weight is 6500 or more and/or (D2) boron-containing ashless dispersant of which weight-average molecular weight is 3000 or more. Therefore, it is capable to obtain a composition which can significantly reduce wear under a condition of soot contamination and is excellent in high-temperature detergency.

The lubricating oil composition of the first and second aspects of the invention is suitably used for diesel engine or direct-injection gasoline engine.

Effects of the Invention

The lubricating oil composition of the first aspect of the present invention is capable to lower the wear and friction and is excellent in high-temperature detergency; it is also excellent in sustention of fuel saving performance even when it is used for internal combustion engine particularly diesel engine and direct-injection gasoline engine these of which tend to have unignorable effect by soot mixing when dosage of phosphorous compound such as ZnDTP is reduced. Hence, it is capable to sufficiently maintain the performance of exhaust-gas after-treatment device for a long term.

The lubricating oil composition of the second aspect of the present invention is capable to lower the wear and friction and is capable to sufficiently maintain the performance of exhaust-gas after-treatment device for a long term even when it is used for internal combustion engine particularly diesel engine and direct-injection gasoline engine these of which tend to have unignorable effect by soot mixing if dosage of phosphorous compound such as ZnDTP is reduced.

Therefore, the lubricating oil composition of the first and second aspects of the invention is not only suitably used for internal combustion engine to be used for vehicles equipped with exhaust-gas after-treatment device, but also suitably used for diesel engine oil, direct-injection engine oil, and the like in which soot is mixed during the operation. The lubricating oil composition is also suitably used for gasoline engine, diesel engine, and gas engine for two-wheel vehicle, four-wheel vehicles, electric power generation, cogeneration, and so on. Moreover, it is not only suitably used for these various engines consuming fuel containing 50 mass ppm or less of sulfur, but also useful for various engines for marine vessel and outboard motor as well as for lubricating oil for other purposes.

BEST MODE FOR CARRYING OUT THE INVENTION

Hereinafter, lubricating oil composition of the present invention will be more specifically described.

<Base Oil (X)>

A lubricant base oil of the lubricating oil composition of the present invention (hereinafter, refer to as "composition of the invention".) contains base oil (X) of which % $C_P$ is 70 or more, % $C_A$ is 1 or less, viscosity index 115 or more, CCS viscosity at −35° C. is 3000 mPa·s or less. As the base oil (X), either of mineral base oil or synthetic base oil may be used as long as it meets the above numerical range.

As the mineral base oil, for example, there may be: a material by refining a lubricating oil fraction obtained by vacuum distillation of topped crude obtained by topping of crude oil by using one or more treatment such as solvent deasphalting, solvent extraction, hydrocracking, hydroisomerization, solvent dewaxing, catalytic dewaxing, hydrorefining, and etc.; wax-cracked/isomerized base oil manufactured by hydrocracking or hydroisomerization of a wax-containing component like wax mainly containing slack wax obtained by solvent dewaxing process and normal paraffin obtained by further deoiling and refining the slack wax; and synthetic wax-cracked/isomerized base oil manufactured by hydrocracking or hydroisomerization of synthetic wax like Fischer-Tropsch wax.

Specific examples of a synthetic base oil include: polybutene or hydrogenated product thereof; poly-α-olefin like α-olefin oligomer of carbon number 6~18, preferably carbon number 8~12 such as 1-octene oligomer, 1-decene oligomer, and 1-dodecene oligomer, or hydrogenated product thereof; diester such as ditridecyl glutalate, di-2-ethylhexyladipate, diisodecyladipate, ditridecyladipate, and di-2-ethylhexylsebacate; polyol ester such as neopentyl glycolester, trimethylolpropane caprylate, trimethylolpropane pelargonate, pentaerythritol-2-ethylhexanoate, and pentaerythritol pelargonate; aromatic synthetic oil such as alkylnaphthalene, alkylbenzene, and aromatic ester, or mixture thereof.

The base oil (X) in the invention may be a mineral base oil, synthetic base oil, or a mixture of the above base oil as long as it meets the above properties. The manufacturing method is not specifically limited; as a preferable example of method for manufacturing base oil (X), the base oil (1)~(8) shown below are used as the raw materials, and the raw material oil and/or a lubricating oil fraction being recovered from the raw material oil are refined by a predetermined refining method, and then, the lubricating oil fraction is recovered, so as to obtain the base oil.

(1) distillated oil obtained by topping of paraffinic crude oil and/or mixed crude;

(2) whole vacuum gas oil (WVGO) of topping residue of paraffinic crude and/or mixed crude;

(3) wax obtained by lubricating oil dewaxing process (slack wax, wax which the slack wax is further deoiled or refined, etc.) and/or synthetic wax (Fischer-Tropsch wax, GTL wax, etc.) obtained by gas-to-liquid (GTL) process or the like;

(4) one of oil or a mixed oil of two or more base oil selected from (1)~(3) and/or mildly hydrocracked (MHC) oil of the mixed oil;

(5) mixed oil of two or more selected from base oil (1)~(4);
(6) de-asphalted oil (DAO) of base oil (1), (2), (3), (4) or (5);
(7) mildly hydrocracked (MHC) oil of base oil (6); and
(8) mixed oil of two or more selected from base oil (1)~(7)

As the above specific refining methods, preferable examples include: hydroreforming such as hydrocracking and hydrofinishing; solvent refining such as furfural solvent extraction; dewaxing such as solvent dewaxing and catalytic dewaxing; clay treatment by acid clay, activated clay, and the like; and chemical (acid or alkali) treatment such as sulfuric acid treatment and caustic soda treatment.

In this invention, refining may be carried out by one of these refining methods alone, or in combination of two or more thereof. When two or more refining methods are combined, the order of the procedure is not particularly limited, it can be adequately determined.

Further, as base oil (X), it is preferably a base oil selected from the above base oil (1)~(8) or the following base oil (9) or (10) obtained by giving specific treatment with a lubricating oil fraction recovered from the base oil.

(9) hydrocracked mineral oil obtained by firstly hydrocracking a base oil selected from the above base oil (1)~(8) or a lubricating oil fraction recovered from the base oil, then giving dewaxing treatment such as solvent dewaxing or catalytic dewaxing with the reaction product or a lubricating oil fraction recovered from the reaction product, or even distillating them after the dewaxing treatment.
(10) hydroisomerization mineral oil obtained by firstly hydroisomerizing a base oil selected from the above base oil (1)~(8) or a lubricating oil fraction recovered from the base oil, then giving dewaxing treatment such as solvent dewaxing and catalytic dewaxing with the reaction product or a lubricating oil fraction recovered from the reaction product, or even distillating them after the dewaxing treatment.

Furthermore, as the base oil (X), between the above base oil (9) and (10), a base oil (X1) obtained by using wax component selected from the above base oil (3) or a material containing the wax component, as a raw material for hydrocracking or hydroisomerization, is most preferable.

Meanwhile, obtaining the lubricant base oil of the above (9) or (10), it is particularly preferable for the dewaxing process to include catalytic dewaxing process in view of further enhancement of thermal-oxidation stability and property of low-temperature viscosity as well as improvement of fatigue prevention performance of the lubricating oil composition. In addition, for obtaining the lubricant base oil of the above (9) or (10), process of solvent refining treatment and/or hydrofinishing treatment may be given, if necessary.

The catalyst to be used for the above hydrocracking and hydroisomerization are not particularly limited. It is preferably a hydrocracking catalyst, wherein a metal having ability of hydrogenaration (e.g., one or more of metal of VIa element or VIII element in periodic table, etc.) is supported on a substrate made of composite oxide (e.g., silica-alumina, alumina-boria, and silica-zirconia) having cracking activity or made of a material having one or more of the composite oxide being adhered each other by binder. It is also preferably a hydroisomerization catalyst, wherein a metal having ability of hydrogenation containing at least one or more metals of VIII element is supported on zeolite (e.g., ZSM-5, zeolite β, SAPO-11, etc.). The hydrocracking catalyst and hydroisomerization catalyst may be used in combination in a form of lamination or mixture thereof.

Reaction condition during hydrocracking and hydroisomerization are not particularly limited. It is preferably set that hydrogen partial pressure is 0.1~20 MPa, average reaction temperature is 150~450° C., LHSV is 0.1~3.0 $hr^{-1}$, hydrogen/oil ratio is 50~20000 scf/b (i.e. standard-cubic-feet/barrel. It is a value obtained by dividing volume of hydrogen gas in standard condition (cubic feet) by volume of oil in the same condition (barrel, 1 b=approx. 159 L).)

When carrying out catalytic dewaxing, hydrocracked-isomerized oil is reacted with hydrogen under an effective condition for lowering pour-point under existence of adequate dewaxing catalyst. About catalytic dewaxing, two or more lubricant base oil are obtained by converting a part of high boiling-point substance in cracked/isomerized product into low boiling-point substance, by separating the low boiling-point substance from heavier base oil fraction, and by fractionally distillating the base oil fraction. Separation of the low boiling-point substance can be done before obtaining the objective lubricant base oil or during the fractional distillation.

As the dewaxing catalyst, it is not particularly limited as long as it can lower the pour-point of cracked/isomerized oil; it is preferably a catalyst which is capable to obtain the objective lubricant base oil in good yield from the cracked/isomerized oil. As such a dewaxing catalyst, shape-selective molecular sieve is preferable; specifically, there may be ferielite, mordenite, ZSM-5, ZSM-11, ZSM-23, ZSM-35, ZSM-22 (it may be called as "theta one" or "TON".), and silica-alumino phophates (SAPO). A series of these molecular sieves is preferably used in combination with catalyst metal component, more preferably used in combination with precious metal. An example of preferable combination thereof is a complex of platinum and H-mordenite.

The dewaxing condition is not particularly limited; it preferably sets the temperature to become 200~500° C. and hydrogen pressure to become 10~200 bar (1~20 MPa). When flow-through reactor is used, $H_2$ processing speed is preferably 0.1~10 kg/hr, LHSV is preferably 0.1~10 $h^{-1}$, and more preferably 0.2~2.0 $h^{-1}$. In addition, the method for dewaxing is preferably carried out such that a substance, of which initial boiling point is 350~400° C. contained in a cracked-isomerized oil at a ratio of normally 40 mass % or less, preferably 30 mass % or less, is to be converted to another substance having a boiling point less than the initial boiling point.

Moreover, another preferable example of the base oil (X) may be poly-α-olefin base oil (X2) having the above properties, specifically, oligomer or cooligomer of α-olefin of carbon number 6~16, preferably 8~12 (e.g., 1-octene oligomer, 1-decene oligomer, and 1-dodecene oligomer) and hydrogenated product thereof are available. Manufacturing method of this poly-α-olefin base oil is not particularly limited; for example, there may be polymerization of α-olefin under an existence of polymerization catalyst such as Friedel-Crafts catalyst containing complex with aluminum trichloride, boron trifluoride, or a combination of boron trifluoride and water, alcohol (e.g., ethanol, propanol, or butanol), carboxylic acid, or ester (e.g., ethyl acetate or ethyl propionate).

As % $C_P$ of the base oil (X), in view of possibility to have excellent properties like thermal-oxidation stability, viscosity-temperature characteristic, and high-temperature detergency and to reduce wear and friction under a condition of soot contamination, it is at least 70 or more, preferably 80 or more, more preferably 85 or more, furthermore preferably 90 or more. The upper limit is not specifically limited, thereby 100 may be acceptable. In view of superior soot dispersancy and solubility of sludge, it is preferably 97 or less, more preferably 95 or less, and furthermore preferably 92 or less.

Also, as % $C_A$ of the base oil (X), in view of possibility to have excellent properties like thermal-oxidation stability, viscosity-temperature characteristic, and high-temperature detergency and to reduce wear and friction under a condition of soot contamination, it must be 1 or less, preferably 0.5 or less, particularly preferably 0.2 or less.

Further, % $C_N$ of the base oil (X) is not particularly limited; in order to have excellent properties like thermal-oxidation stability, viscosity-temperature characteristic, and high-temperature detergency, and to reduce wear and friction under a condition of soot contamination, it is preferably 30 or less, more preferably 20 or less, further preferably 15 or less, and furthermore preferably 10 or less. The lower limit is not specifically limited; in view of superior soot dispersancy and solubility of sludge, it is preferably 3 or more, more preferably 5 or more, and furthermore preferably 8 or more.

Further, % $C_P$/% $C_N$ of the base oil (X) is not particularly limited; in view of possibility to have excellent properties like thermal-oxidation stability, viscosity-temperature characteristic, and high-temperature detergency and to reduce wear and friction under a condition of soot contamination, it is preferably 4 or more, more preferably 6 or more, and particularly preferably 9 or more. The upper limit is not specifically limited; in view of superior soot dispersancy and solubility of sludge, it is preferably 40 or less, more preferably 15 or less, furthermore preferably 12 or less.

Here, the % $C_A$, % $C_P$, and % $C_N$ means respectively aromatic carbon number to total carbon number in percentage, paraffinic carbon number to total carbon number in percentage, and naphthenic carbon number to total carbon number in percentage, these of which can be obtained by a method in accordance with ASTM D 3238-85 (n-d-M ring analysis). Accordingly, the preferable range of the above % $C_P$, % $C_N$, and % $C_A$ is based on the values obtained by the above method. For instance, even if the lubricant base oil without containing naphthenic compound is used, the value may goes beyond 0.

Viscosity index of the base oil (X), in view of possibility to have excellent thermal-oxidation stability, viscosity-temperature characteristic, and high-temperature detergency and to reduce wear and friction under a condition of soot contamination, it must be 115 or more, preferably 120 or more, and more preferably 125 or more. Further, the upper limit of viscosity index of the base oil (X) is normally 200 or less, and preferably 160 or less. As the above base oil (X1), the viscosity index is suitably between 130 and 160, and particularly suitably between 135 and 150. As the base oil (X2), the viscosity index is suitably between 115 and 160, particularly suitably between 120 and 130.

Moreover, as the base oil (X), in view of excellent fuel saving performance at a time of low-temperature starting, CCS viscosity at −35° C. is necessarily 3000 mPa·s or less, it is preferably 2400 mPa·s or less, more preferably 2000 mPa·s or less, furthermore preferably 1900 mPa·s or less, and particularly preferably 1800 mPa·s or less. Especially, the above-described base oil (X2) of which CCS viscosity at −35° C. is preferably 1700 mPa·s or less, more preferably 1600 mPa·s or less is particularly suitably used. By using the base oil (X) of which CCS viscosity is lower, it is capable to have higher viscosity of the below-mentioned base oil (Y) or to raise the content of the base oil (Y), which makes it possible to maintain the fuel saving performance at a time of low-temperature starting and also to significantly improve the anti-wear property under a condition of soot contamination.

Kinematic viscosity at 100° C. of the base oil (X) is not particularly limited; it is within the range of 1~20 $mm^2/s$, preferably 2~8 $mm^2/s$, more preferably 3~5 $mm^2/s$, and particularly preferably 3.5~4.5 $mm^2/s$. When the kinematic viscosity at 100° C. of the base oil (X) is over 20 $mm^2/s$, property of low-temperature viscosity is deteriorated; meanwhile, when the kinematic viscosity becomes below 1 $mm^2/s$, the lubricity is inferior due to the insufficient oil-film forming at lubrication points. Moreover, evaporation loss of the lubricant base oil becomes larger in both cases, thereby the both cases are not preferable.

Pour-point of the base oil (X) is not particularly limited; it is preferably −10° C. or less, more preferably −15° C. or less, furthermore preferably −17.5° C. or less. By setting the pour-point of the base oil (X) to −10° C. or less, it is capable to obtain a lubricating oil composition which is excellent in property of low-temperature viscosity. Also, as the above-mentioned base oil (X1), in view of balance among property of low-temperature viscosity, viscosity index, and economic efficiency of dewaxing process, the pour-point is preferably −40° C. or more, more preferably −30° C. or more, and particularly preferably −25° C. or more. In addition, as the above-mentioned base oil (X2), the pore-point is preferably −40° C. or less, more preferably −45° C. or less, and in view of balance among property of low-temperature viscosity, viscosity index, and economic efficiency of manufacturing process, −70° C. or more is preferable.

Aniline point of the base oil (X) is not particularly limited; it is preferably 108° C. or more, more preferably 115° C. or more, and further preferably 120° C. or more; the upper limit is not specifically limited. As one example of this invention, the aniline point may be 125° C. or more, in view of superior soot dispersancy, solubility of sludge, and compatibility of seal material, it is preferably 125° C. or less.

Sulfur content of the base oil (X) is not particularly limited; it is preferably 0.1 mass % or less, more preferably 0.05 mass % or less, furthermore preferably 0.01 mass % or less, and particularly preferably 0.001 mass % or less.

NOACK evaporation of the base oil (X) is not particularly limited; it is preferably 8~20 mass %, more preferably 10~16 mass %, and particularly preferably 12~14 mass %. By setting NOACK evaporation within the above range, it is capable to have excellent high-temperature detergency, and to reduce wear and friction under a condition of soot contamination, but also it is capable to inhibit increase of viscosity of lubricating oil in use, and to easily maintain fuel saving performance for a long term. Thus, the above range is particularly preferable. The "NOACK evaporation" in the present invention means an amount of evaporation loss measured in accordance with ASTM D 5800-95.

Iodine number of the base oil (X) is not particularly limited. In view of possibility to have excellent high-temperature detergency and to reduce wear and friction under a condition of soot contamination, it is preferably 8 or less, more preferably 6 or less; in view of economic efficiency in the manufacturing method, it is preferably 0.001 or more, more preferably 0.01 or more. As the above base oil (X1), the iodine number is suitably 2 or less, more suitably 1 or less, further suitably 0.5 or less, and particularly suitably 0.1 or less. Further, as the above-mentioned base oil (X2), in view of balance between the above characteristics and economic efficiency of the manufacturing process, the iodine number is preferably 8 or less, more preferably 6 or less, and 0.001 or more, specifically suitably between 0.2 and 6, more suitably between 0.3 and 4, and particularly suitably between 0.4 and 1. Here, the "iodine number" of the invention means the iodine number measured in accordance with an indicator titration method in JIS K 0070 "Test methods for acid number, saponification number, iodine number, hydroxyl number and unsaponifiable matter of chemical products".

In the lubricant base oil to be used for the present invention, content of the base oil (X) is not particularly limited; to total mass of the lubricant base oil, it is preferably 10 mass % or more, more preferably 30 mass % or more, further preferably 50 mass % or more, furthermore preferably 60 mass % or more, and it may be 100 mass %. In view of solubility of additives, sludge solubility and effects of additives, and economic efficiency, it is preferably 90 mass % or less, more preferably 80 mass % or less, furthermore preferably 70 mass % or less.

In the lubricant base oil of the invention, as long as the above base oil (X) is contained, one or more base oil selected from a group of base oil which does not meet the requirement of the base oil (X) among the above-mentioned mineral base oil and synthetic base oil may be used. Such a base oil (Y) may be selected from base oil as follows:

(Y1) base oil of which CCS viscosity at −35° C. is over 3000 mPa·s (e.g., a base oil of which CCS viscosity at −35° C. is over 3000 mPa·s, preferably 100000 mPa·s or less, more preferably 3500~15000 mPa·s.);

(Y2) base oil of which % $C_P$ is less than 70 (e.g., a base oil of which % $C_P$ is less than 50~70, preferably less than 60~70.);

(Y3) base oil of which % $C_A$ is over 1 (e.g., base oil of which % $C_A$ is over 1 and 20 or less, preferably 10 or less, more preferably 3 or less.);

(Y4) base oil of which viscosity index is less than 120 (e.g., base oil of which viscosity index is preferably less than 80~120.); and (Y5) base oil which does not meet two or more requirements of the base oil (X).

Among these, (Y1) is preferable; as a more preferable example, in view of possibility to improve lubricating oil composition in terms of thermal-oxidation stability, viscosity-temperature characteristic, high-temperature detergency, and reduction of wear and friction under a condition of soot contamination in a well-balanced manner, (Ya) base oil of which viscosity index is 80 or more, % $C_P$ is 60 or more, % $C_A$ is 10 or less, kinematic viscosity at 100° C. is 5 $mm^2/s$ or more, and CCS viscosity at −35° C. is over 3000 mPa·s.

The viscosity index of the base oil (Ya) is: preferably 100 or more, more preferably 120 or more, and preferably 170 or less, more preferably 135 or less; the % $C_P$ is preferably 70 or more, more preferably 75 or more, and preferably 100 or less, more preferably 85 or less; the % $C_A$ is preferably 3 or less, more preferably 2 or less, and furthermore preferably 1 or less; the CCS viscosity at −35° C. is over 3000 mPa·s, preferably 3500 mPa·s or more, and preferably 100000 mPa·s or less, more preferably 50000 mPa·s or less, furthermore preferably 15000 mPa·s or less.

Kinematic viscosity at 100° C. of these base oil (Y), namely, base oil (Y1)~(Y5) or (Ya) is preferably 5 $mm^2/s$ or more, more preferably 6 $mm^2/s$ or more, and preferably 35 $mm^2/s$ or less, more preferably 20 $mm^2/s$ or less, further preferably 12 $mm^2/s$ or less, and particularly preferably 8 $mm^2/s$ or less. As a base oil (Y), using a base oil of which kinematic viscosity at 100° C. is 5 $mm^2/s$ or more, it is capable to have excellent anti-wear property under a condition of soot contamination, to easily maintain low-friction performance by reducing evaporation loss thereby inhibiting increase of viscosity even for prolonged use, and to improve fuel saving performance at a time of low-temperature starting and cold shutdown by using a base oil of which kinematic viscosity at 100° C. is 35 $mm^2/s$ or less.

NOACK evaporation of these base oil (Y), namely, base oil (Y1)~(Y5) or (Ya) is not particularly limited; it is preferably 0~25 mass %, more preferably 2~15 mass %, and particularly preferably 5~10 mass %. By selecting base oil (Y) of which NOACK evaporation is small, it is capable to easily maintain low-friction performance by reducing evaporation loss thereby inhibiting increase of viscosity even for prolonged use. Also, by selecting base oil of which NOACK evaporation is 2 mass % or more, as it is capable to easily obtain a lubricating oil composition which is excellent in property of low-temperature viscosity, therefore it is especially preferable.

Sulfur portion of these base oil (Y), namely, base oil (Y1)~(Y5) or (Ya) is not particularly limited; it is preferably 1 mass % or less, more preferably 0.3 mass % or less, further preferably 0.1 mass % or less, and particularly preferably 0.01 mass % or less. By reducing the sulfur content, it is capable to obtain a composition of which thermal-oxidation stability, high-temperature detergency and low-friction property are enhanced.

Iodine number of these base oil (Y), namely, base oil (Y1)~(Y5) or (Ya) is not particularly limited; in view of possibility to have excellent high-temperature detergency and to reduce wear and friction under a condition of soot contamination, it is preferably 8 or less, more preferably 6 or less; in view of economic efficiency during manufacturing process, it is preferably 0.01 or more, more preferably 1 or more, furthermore preferably 3 or more.

When the above base oil (Y) is used as a constituent of the lubricant base oil of the invention, the content is not specifically limited; to total mass of lubricant base oil, it is preferably 10 mass % or more, more preferably 20 mass % or more, furthermore preferably 30 mass % or more, and preferably 90 mass % or less, more preferably 70 mass % or less, further preferably 50 mass % or less.

In the lubricant base oil of the invention containing the above base oil (X), kinematic viscosity at 100° C. is prepared at preferably 3~8 $mm^2/s$, more preferably 3.5~6 $mm^2/s$, furthermore preferably 4~5.5 $mm^2/s$, the viscosity index is preferably 110 or more, more preferably 115 or more, further preferably 120 or more, and particularly preferably 125 or more. Sulfur content of the lubricant base oil of the invention containing the above base oil (X) is not particularly limited; it is preferably 0.3 mass % or less. In view of possibility to enhance the high-durability such as property of base-number retention, it is preferably 0.1 mass % or less, more preferably 0.05 mass % or less, and furthermore preferably 0.005 mass % or less. NOACK evaporation of the lubricant base oil of the invention containing the above base oil (X) is not particularly limited; it is preferably 5~25 mass %, more preferably 10~20 mass %, and particularly preferably 12~15 mass %.

Further, property of low-temperature viscosity of the lubricant base oil containing the above base oil (X) is not particularly limited; it is desirable to set the CCS viscosity at −30° C. to preferably 20000 mPa·s or less, more preferably 7000 mPa·s or less, furthermore preferably 3500 mPa·s or less. Here, CCS viscosity means a viscosity at a specific temperature measured in accordance with JIS K 2010.

<(A) Component>

The lubricating oil composition of the first embodiment of the invention contains an ashless friction modifier as (A) component. As (A) ashless friction modifier, any kind of compounds which are conventionally used as a friction modifier for lubricating oil may be used. Examples thereof include: ashless friction modifier such as amine compound, imide compound, fatty acid ester, fatty acid amide, fatty acid, aliphatic alcohol, and aliphatic ether respectively having at least one of hydrocarbon group, preferably alkyl group or alkenyl group of carbon number 6~30, particularly straight-chain alkyl group or straight-chain alkenyl group of carbon number 6~30 within the molecule, or various ashless friction modifier having hydrocarbon group of carbon number 1~30 and two atoms or more of nitrogen atom. In the present invention, among these ashless friction modifiers, an ashless friction modifier having ester bond or amide bond is preferable, an ashless friction modifier having at least three atoms or more of one or more elements selected from nitrogen, oxygen, and sulfur is preferable, an ashless friction modifier selected from compounds having two or more of nitrogen atoms as well as oxygen atom and/or sulfur atom. Among them, the modifier having amide bonds is most preferable.

Examples of the amine compound include: straight-chain or branched, preferably straight-chain aliphatic monoamine of carbon number 6~30; straight-chain or branched, preferably straight-chain aliphatic polyamine of carbon number 6~30; or alkyleneoxide adduct of the aliphatic amine of carbon number 6~30. Examples of the fatty acid ester include an ester of straight-chain or branched, preferably an ester of straight-chain fatty acid of carbon number 7~31 with aliphatic monovalent alcohol or aliphatic polyvalent alcohol. Examples of fatty acid amide include an amide of straight-chain or branched, preferably straight-chain fatty acid of carbon number 7~31 with aliphatic monoamine or aliphatic polyamine.

Suitable examples of ashless friction modifier having at least three atoms or more of one or more elements selected from nitrogen, oxygen, and sulfur include: ester having trivalent or more of polyalcohol such as glycerin and sorbitan, and fatty acid such as oleic acid; and below-mentioned compound having two or more nitrogen atoms and oxygen atom and/or sulfur atom.

Also, as various ashless friction modifiers selected from compounds having two or more nitrogen atoms and oxygen atom and/or sulfur atom, there may be compounds having two to ten nitrogen atoms, preferably two to four nitrogen atoms, particularly preferably two nitrogen atoms, with oxygen atom and/or sulfur atom, preferably one to four oxygen atoms, more preferably one to two atoms. Among them, compounds having amide bonds are preferable. More specific examples thereof may be compounds listed in the International Publication No. 2005/037967, such as hydrazide (oleic hydrazide, etc.), semicarbazide (oleyl semicarbazide, etc.), urea (oleyl urea, etc.), ureido (oleyl ureido, etc.), allophanic acid amide (oleyl allophanic acid amide, etc.), and derivatives thereof. Among these, one or more compounds selected from a group consisting of compounds containing nitrogen represented by the following general formula (1) and (2) as well as acid modification derivatives thereof are particularly preferable.

(General formula 1)

(1)

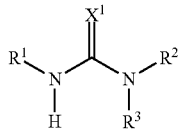

In the general formula (1), $R^1$ is hydrocarbon group of carbon number 1~30 or functional hydrocarbon group of carbon number 1~30, preferably hydrocarbon group of carbon number 10~30 or functional hydrocarbon group of carbon number 10~30, more preferably alkyl group, alkenyl group, or functional hydrocarbon group of carbon number 12~24, particularly preferably alkenyl group of carbon number 12~20; $R^2$ and $R^3$ are respectively hydrocarbon group of carbon number 1~30, functional hydrocarbon group of carbon number 1~30 or hydrogen, preferably hydrocarbon group of carbon number 1~10, functional hydrocarbon group of carbon number 1~10 or hydrogen, further preferably hydrocarbon group of carbon number 1~4 or hydrogen, more preferably hydrogen; $X^1$ is oxygen or sulfur, preferably oxygen. The most preferable example of the nitrogen-containing compound represented by the general formula (1) is specifically a compound of which $X^1$ is oxygen and acid modification derivatives thereof. More specifically, urea compounds having alkyl group or alkenyl group of carbon number 12~24 of which $X^1$ is oxygen; $R^1$ is alkyl group or alkenyl group of carbon number 12~24; $R^2$ and $R^3$ are respectively hydrogen, wherein the alkyl group or alkenyl group of carbon number 12~24 may include: dodecylurea, tridecylurea, tetradecylurea, pentadecylurea, hexadecylurea, heptadecylurea, octadecylurea, oleyl urea; and acid modification derivatives thereof. Among these, oleyl urea ($C_{18}H_{35}$—NH—C(=O)—$NH_2$) and acid modification derivatives thereof (borate modification derivatives, etc.) are particularly preferable.

(General formula 2)

(2)

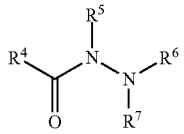

In the general formula (2), $R^4$ is hydrocarbon group of carbon number 1~30 or functional hydrocarbon group of carbon number 1~30, preferably hydrocarbon group of carbon number 10~30 or functional hydrocarbon group of carbon number 10~30, more preferably alkyl group, alkenyl group, or functional hydrocarbon group of carbon number 12~24, particularly preferably alkenyl group of carbon number 12~20; $R^5$~$R^7$ are respectively hydrocarbon group of carbon number 1~30, functional hydrocarbon group of carbon number 1~30 or hydrogen, preferably hydrocarbon group of carbon number 1~10, functional hydrocarbon group of carbon number 1~10 or hydrogen, more preferably hydrocarbon group of carbon number 1~4 or hydrogen, furthermore preferably hydrogen.

Specific examples of nitrogen-containing compound represented by general formula (2) include hydrazide having hydrocarbon group of carbon number 1~30 or functional hydrocarbon group of carbon number 1~30, and derivatives thereof. When $R^4$ is hydrocarbon group of carbon number 1~30 or functional hydrocarbon group of carbon number 1~30 and $R^5$~$R^7$ are hydrogen, the nitrogen-containing compound is hydrazide having hydrocarbon group of carbon number 1~30 or functional hydrocarbon group of carbon number 1~30; and when any one of $R^4$ and $R^5$~$R^7$ are hydrocarbon group of carbon number 1~30 or functional hydrocarbon group of carbon number 1~30 and rest of $R^5$~$R^7$ are hydrogen, it is N-hydrocarbyl hydrazide (hydrocarbyl indicates hydrocarbon group and the like.) having hydrocarbon group of carbon number 1~30 or functional hydrocarbon group of carbon number 1~30. The most preferable examples of nitrogen-containing compounds represented by the general formula (2) include a hydrazide compound having alkyl group or alkenyl group of carbon number 12~24 of which $R^4$ is alkyl group or alkenyl group of carbon number 12~24, $R^5$~$R^7$ are hydrogen: such as dodecanoic hydrazide, tridecanoic hydrazide, tetradecanoic hydrazide, pentadecanoic hydrazide, hexadecanoic hydrazide, heptadecanoic hydrazide, octadecanoic hydrazide, oleic hydrazide, erucic acid hydrazide; and acid modification derivatives thereof (borate modification derivatives, etc.). Among these, oleic hydrazide ($C_{17}H_{33}$—C(=O)—NH—$NH_2$) and acid modification derivatives thereof, erucic acid hydrazide ($C_{21}H_{41}$—C(=O)—NH—$NH_2$), and acid modification derivatives thereof are specifically preferable.

Manufacturing method and the preferable embodiment related to the various ashless friction modifiers having two or more nitrogen atoms in these molecules are described in detail in the above International Publication No. 2005/037967; optionally, such ashless friction modifiers may be contained in the lubricating oil composition of the invention in a form of complex or salt with organometallic compound. The various ashless friction modifiers having two or more nitrogen atoms and oxygen atom and/or sulfur atom in these molecules can realize friction reducing effect at a level where conventional friction reducers like molybdenum dithiocarbamate perform or more, but also it can retard the deterioration of friction reducing effect under a condition of soot contamination, and duration of the effect can be easily prolonged. Thus it is particularly preferable.

Dosage of (A) ashless friction modifier in the lubricating oil composition of the invention, to total mass of the composition, is 0.01~10 mass %, preferably 0.1 mass % or more, more preferably 0.3 mass % or more, and preferably 3 mass % or less, more preferably 2 mass % or less, and further preferably 1 mass % or less. If dosage of the ashless friction modifier is less than 0.01 mass %, friction reducing effect derive from the addition tends to become insufficient; meanwhile, if dosage of the same is become over 10 mass %, effects derive from anti-wear additives tend to be inhibited or solubility of the additives tends to be deteriorated.

<(A1) Component>

In the lubricating oil composition of the second embodiment of the invention, as (A1) component, at least one molybdenum friction modifier selected from molybdenum dithiophosphate and molybdenum dithiocarbamate is contained.

As molybdenum dithiophosphate, compounds represented by the following general formula (3) is the example.

(General formula 3)

(3)

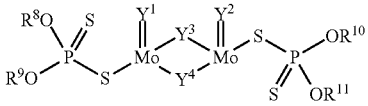

In the general formula (3), $R^8$, $R^9$, $R^{10}$, and $R^{11}$ may be the same or different from each other; these indicate alkyl group of carbon number 2~30, preferably carbon number 5~18, and more preferably carbon number 5~12, or hydrocarbon group like (alkyl) aryl group of carbon number 6~18, preferably carbon number 10~15. On the other hand, $Y^1$, $Y^2$, $Y^3$, and $Y^4$ respectively indicate sulfur atom or oxygen atom.

Preferable examples of alkyl group include: ethyl, propyl, butyl, pentyl, hexyl, heptyl, octyl, nonyl, decyl, undecyl, dodecyl, tridecyl, tetradecyl, pentadecyl, hexadecyl, heptadecyl, and octadecyl. These may be primary alkyl group, secondary alkyl group, or tertiary alkyl group, and it also may be straight-chain or branched alkyl group.

Preferable examples of (alkyl) aryl group include: phenyl, tolyl, ethylphenyl, propylphenyl, butylphenyl, pentylphenyl, hexylphenyl, octylphenyl, nonylphenyl, decylphenyl, undecylphenyl, and dodecylphenyl. The alkyl group thereof may be primary alkyl group, secondary alkyl group, or tertiary alkyl group; it also may be straight-chain or branched. In these (alkyl) aryl groups, all substituted isomers where site of substitution of alkyl group to aryl group is different are included.

As preferable molybdenum dithiophosphate, specific examples include: molybdenum sulfide diethyl dithiophosphate, molybdenum sulfide dipropyl dithiophosphate, molybdenum sulfide dibutyl dithiophosphate, molybdenum sulfide dipentyl dithiophosphate, molybdenum sulfide dihexyl dithiophosphate, molybdenum sulfide dioctyl dithiophosphate, molybdenum sulfide didecyl dithiophosphate, molybdenum sulfide didodecyl dithiophosphate, molybdenum sulfide di(butylphenyl) dithiophosphate, molybdenum sulfide di(nonylphenyl) dithiophosphate, oxymolybdenum sulfide diethyl dithiophosphate, oxymolybdenum sulfide dipropyl dithiophosphate, oxymolybdenum sulfide dibutyl dithiophosphate, oxymolybdenum sulfide dipentyl dithiophosphate, oxymolybdenum sulfide dihexyl dithiophosphate, oxymolybdenum sulfide dioctyl dithiophosphate, oxymolybdenum sulfide didecyl dithiophosphate, oxymolybdenum sulfide didodecyl dithiophosphate, oxymolybdenum sulfide di(butylphenyl)dithiophosphate, oxymolybdenum sulfide di(nonylphenyl)dithiophosphate (the alkyl group may be straight-chain or branched, and, bonding position of the alkyl group of alkylphenyl group is arbitrary.), and mixture thereof. As such a molybdenum dithiophosphate, compound having hydrocarbon groups of different carbon number and/or structures in one molecule may be preferably used.

As molybdenum dithiocarbamate, specifically, compounds represented by the following general formula (4) may be used.

(General formula 4)

(4)

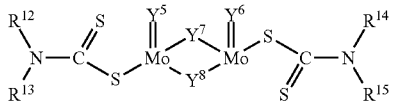

In the above general formula (4), $R^{12}$, $R^{13}$, $R^{14}$, and $R^{15}$ are respectively the same or different from each other; these indicate alkyl group of carbon number 2~24, preferably carbon number 4~13, or hydrocarbon group like (alkyl) aryl group of carbon number 6~24, preferably carbon number 10~15. On the other hand, $Y^5$, $Y^6$, $Y^7$, and $Y^8$ respectively indicate either sulfur atom or oxygen atom.

Preferable examples of alkyl group include: ethyl, propyl, butyl, pentyl, hexyl, heptyl, octyl, nonyl, decyl, undecyl, dodecyl, tridecyl, tetradecyl, pentadecyl, hexadecyl, heptadecyl, and octadecyl. These may be primary alkyl group, secondary alkyl group or tertiary alkyl group; these also may be straight-chain or branched.

Preferable examples of (alkyl) aryl group include: phenyl, tolyl, ethylphenyl, propylphenyl, butylphenyl, pentylphenyl, hexylphenyl, octylphenyl, nonylphenyl, decylphenyl, undecylphenyl, and dodecylphenyl. The alkyl group thereof may be primary alkyl group, secondary alkyl group, or tertiary alkyl group; these also may be straight-chain or branched. Further, in these (alkyl) aryl groups, all substituted isomers, where site of substitution of alkyl group to aryl group is different, are included. Furthermore, examples of molybdenum dithiocarbamate having structures other than those of the above include a compound having a structure where thio- or polythio-trinuclear molybdenum is coordinated by dithiocarbamate, as disclosed in WO98/26030 or WO99/31113.

Preferable examples of molybdenum dithiocarbamate specifically include: molybdenum sulfide diethyl dithiocarbamate, molybdenum sulfide dipropyl dithiocarbamate, molybdenum sulfide dibutyl dithiocarbamate, molybdenum sulfide dipentyl dithiocarbamate, molybdenum sulfide dihexyl dithiocarbamate, molybdenum sulfide dioctyl dithiocarbamate, molybdenum sulfide didecyl dithiocarbamate, molybdenum sulfide didodecyl dithiocarbamate, molybdenum sulfide di(butylphenyl)dithiocarbamate, molybdenum sulfide di(nonylphenyl)dithiocarbamate, oxymolybdenum sulfide diethyl dithiocarbamate, oxymolybdenum sulfide dipropyl dithiocarbamate, oxymolybdenum sulfide dibutyl dithiocarbamate, oxymolybdenum sulfide dipentyl dithiocarbamate, oxymolybdenum sulfide dihexyl dithiocarbamate, oxymolybdenum sulfide dioctyl dithiocarbamate, oxymolybdenum sulfide didecyl dithiocarbamate, oxymolybdenum sulfide didodecyl dithiocarbamate, oxymolybdenum sulfide di(butylphenyl)dithiocarbamate, and oxymolybdenum sulfide di(nonylphenyl)dithiocarbamate (the alkyl group may be straight-chain or branched; the bonding position of the alkyl group of alkylphenyl group is arbitrary.); and mixture thereof. As such a molybdenum dithiocarbamate, compound having hydrocarbon groups of different carbon number and/or structures in one molecule may be preferably used.

In the composition of the second embodiment of the invention, dosage of at least one of molybdenum friction modifier selected from molybdenum dithiophosphate and molybdenum dithiocarbamate as (A1) component, to total mass of the composition, must be 0.005 mass % or more, preferably 0.01 mass % or more equivalent to molybdenum element. It must be 0.2 mass % or less, it is preferably 0.1 mass % or less, more preferably 0.05 mass % or less, and particularly preferably 0.03 mass % or less. If the dosage is less than 0.005 mass %, thermal-oxidation stability of the lubricating oil composition becomes insufficient, and especially, the lubricating oil tends to be unable to maintain superior detergency for a long term. On the other hand, if dosage of the same is over 0.2 mass %, effect in proportion to the dosage cannot be obtained, and storage stability of the lubricating oil composition tends to decline.

<(B) Component>

(B) component of the lubricating oil composition of the first and second embodiments of the invention is phosphorus-containing anti-wear agent. The phosphorus-containing anti-wear agent is not particularly limited as long as it is an anti-wear agent containing phosphorus in the molecule. For example, it is preferably one compound selected from a group consisting of: phosphorous compound represented by the following general formula (5), phosphorous compound represented by the following general formula (6), metal salts thereof, amine salts thereof, and derivatives thereof.

(General formula 5)

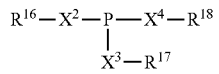

(5)

In the formula (5), $X^2$, $X^3$, and $X^4$ respectively indicate oxygen atom or sulfur atom; $R^{16}$, $R^{17}$, and $R^{18}$ respectively indicate hydrogen atom or hydrocarbon group of carbon number 1~30.

(General formula 6)

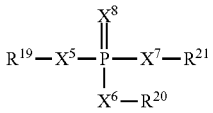

(6)

In the formula (6), $X^5$, $X^6$, $X^7$, and $X^8$ respectively indicate oxygen atom or sulfur atom (one or two of $X^5$, $X^6$, and $X^7$ may be chain of single bond or (poly)oxyalkylene group.); $R^{19}$, $R^{20}$, and $R^{21}$ respectively indicate hydrogen atom or hydrocarbon group of carbon number 1~30.

Examples of hydrocarbon group of carbon number 1~30 represented by the above $R^{16}$~$R^{21}$ include: alkyl group, cycloalkyl group, alkenyl group, alkyl-substituted cycloalkyl group, aryl group, alkyl-substituted aryl group, and arylalkyl group; these are preferably alkyl group of carbon number 1~30 or aryl group of carbon number 6~24, more preferably alkyl group of carbon number 3~18, furthermore preferably alkyl group of carbon number 4~12. The above hydrocarbon groups may include any one of oxygen atom, nitrogen atom, and sulfur atom in the molecules thereof, it is desirably hydrocarbon having carbon and hydrogen.

Examples of phosphorous compound represented by the general formula (5) include: phosphorous acid, monothiophosphite, dithiophosphite, trithiophosphite; phosphite monoester, monothiophosphite monoester, dithiophosphite monoester, trithiophosphite monoester respectively having one of the above-listed hydrocarbon group of carbon number 1~30; phosphitediester, monothiophosphite diester, dithiophosphite diester, trithiophosphite diester respectively having two of the above-listed hydrocarbon groups of carbon number 1~30; phosphite triester, monothiophosphite triester, dithiophosphite triester, trithiophosphite triester respectively having three of the above-listed hydrocarbon groups of carbon number 1~30; and mixture of the above compounds.

Examples of phosphorous compound represented by the general formula (6) include: phosphoric acid, monothiophosphate, dithiophosphate, trithiophosphate, and tetrathiophosphate; phosphate monoester, monothiophosphate monoester, dithiophosphate monoester, trithiophosphate monoester, tetrathiophosphate monoester respectively having one of the above-listed hydrocarbon group of carbon number 1~30; phosphate diester, monothiophosphate diester, dithiophosphate diester, trithiophosphate diester, tetrathiophosphate diester respectively having two of the above-listed hydrocarbon groups of carbon number 1~30; phosphate triester, monothiophosphate triester, dithiophosphate triester, trithiophosphate triester, tetrathiophosphate triester respectively having three of the above-listed hydrocarbon groups of carbon number 1~30; phosphonic acid, phosphonate monoester, phosphonate diester respectively having one to three of the above-listed hydrocarbon groups of carbon number 1~30; the above phosphorous compound having (poly) oxyalkylene group of carbon number 1~4; derivatives of the above phosphorous compound such as β-dithiophosphorylised propionic acid or reactant of dithio phosphate with olefin cyclopentadiene or (methyl)methacrylic acid; and mixture of the above compounds.

As salts of phosphorous compound represented by the general formula (5) or (6), there may be a salt which can be obtained by reacting phosphorous compound with metallic base such as metal oxide, metal hydroxide, metal carbonate, metal chloride, ammonia, nitrogen compound such as amine compound only containing hydrocarbon group of carbon number 1~30 or hydrocarbon-group-containing hydroxyl group in the molecules, and neutralizing a part of or entire remaining acidic hydrogen.

Specific metal of the above metallic base include: alkali metal such as lithium, sodium, potassium, and cesium; alkali earth metal such as calcium, magnesium, and barium; heavy metal such as zinc, copper, iron, lead, nickel, silver, and manganese; and the like. Among these, it is preferably alkali earth metal like calcium, and magnesium, as well as zinc.

Specific examples of the above nitrogen compound are ammonia, monoamine, diamine, and polyamine, more specifically, same compounds as the amine compound constituting amine complex of below-described molybdenum in (E2) component.

Among these nitrogen compounds, the preferable examples are aliphatic amine having alkyl group or alkenyl group of carbon number 10~20 such as decylamine, dodecylamine, dimethyl dodecylamine, tridecylamine, heptadecylamine, octadecylamine, oleyl amine, and stearylamine (these may be straight-chain or branched.).

As (B) component of the invention, the above phosphorus-containing anti-wear agent preferably contains at least one compound selected from the following (B1)~(B3) as the main component so as to introduce the component into the lubricating oil composition of the invention:

(B1) zinc dialkyl dithiophosphate having secondary alkyl group of any one of carbon number 3~8;

(B2) zinc dialkyl dithiophosphate having primary alkyl group of any one of carbon number 3~8; and (B3) sulfur-free phosphorus-containing acid metal salt.

Examples of the above (B1) and (B2) components are represented by the following general formula (7).

(General formula 7)

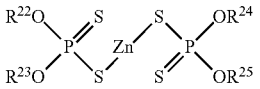

(7)

In the formula, $R^{22}$, $R^{23}$, $R^{24}$, and $R^{25}$ may be the same or different from each other, these respectively indicate secondary alkyl group or primary alkyl group of carbon number 3~8, preferably secondary alkyl group of carbon number 3~6 or primary alkyl group of carbon number 6~8; alkyl group of different carbon number and alkyl group (secondary, primary) of different structure may coexist in one molecule.

In the invention, to facilitate inhibition of wear with low concentration of the lubrication oil composition under a condition of soot contamination, (B1) zinc dialkyldithio phosphate having secondary alkyl group of any one of carbon number 3~8 may be preferably contained; to further improve oxidation stability and to significantly enhance the property of base-number retention, (B2) zinc dialkyldithio phosphate having primary alkyl group of any one of carbon number 3~8 may be preferably contained; and to enhance wear-inhibiting performance under a condition of soot contamination and property of base-number retention in a well-balanced manner at high level, using a combination of (B1) and (B2) components is preferable.

Manufacturing method of zinc dithiophosphate may be carried out by various conventional methods, so it is not limited. For example, it can be synthesized by reacting alcohol having alkyl group corresponding to the above respective $R^{22}$, $R^{23}$, $R^{24}$, and $R^{25}$ with diphosphorus pentasulfide to make dithiophosphate, and neutralizing this with zinc oxide.

The above (B3) component is a metal salt of sulfur-free phosphorus-containing acid. Typical examples are: metal salt of phosphorous compound where all of $X^2$~$X^4$ in the above general formula (5) are oxygen atom (one or two of the $X^2$, $X^3$, and $X^4$ may be chain of single bond or (poly)oxyalkylene group.); and metal salt of phosphorous compound where all of $X^5$~$X^8$ in the above general formula (6) are oxygen atom (one or two of the $X^5$, $X^6$, and $X^7$ may be chain of single bond or (poly)oxyalkylene group.) Since the (B3) components enable to significantly enhance long-drain performance of the invention, such as high-temperature detergency, oxidation stability, and property of base-number retention, it can be preferably used.

Metal salt of the above phosphorous compound may have different structure depending on valency of the metal and number of hydroxyl group of the phosphorous compound, so the structure is not particularly limited. For instance, when one mole of zinc oxide and two moles of phosphate diester (having one hydroxyl group) are reacted, a compound of which structure is represented by the following general formula (8) is possibly obtained as a main component. However, polymerized molecules also possibly exist at the same time.

(General formula 8)

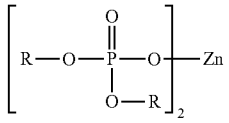

(8)

Further, for example, when one mole of zinc oxide and one mole of phosphate monoester (having two hydroxyl groups) are reacted, compound of which structure is represented by the following general formula (9) is possibly obtained as a main component. However, polymerized molecules also possibly exist at the same time.

(General formula 9)

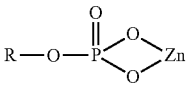

(9)

The (B3) component preferably include: salt of phosphite diester having two alkyl group or aryl group of carbon number 3~18 with zinc; salt of phosphate monoester having one alkyl group or aryl group of carbon number 3~18 with zinc; salt of phosphate diester having two alkyl group or aryl group of carbon number 3~18 with zinc; and salt of phosphonic acid monoester having two alkyl group or aryl group of carbon number 1~18 with zinc. The component may be formed by one of the above salts or optionally blending two or more of the above salts. In the invention, in view of superior anti-wear property under a condition of soot contamination, alkyl phosphate ester metal salt having one or two alkyl group of carbon number 4~12 is preferable, mono- and/or di-alkyl phosphate ester metal salt having one or two alkyl group of carbon number 6~8 is more preferable, and mono- and di-2-zinc ethylhexyl phosphate is particularly preferable.

The upper limit of the dosage of phosphorus-containing anti-wear agent in the lubricating oil composition of the invention, i.e. one component preferably selected from the above (B1), (B2), and (B3), as phosphorous content, is 0.2 mass % or less, preferably 0.1 mass % or less, more preferably 0.08 mass % or less, and specifically preferably 0.06 mass % or less. Meanwhile, the lower limit, in view of possibility to easily inhibit wear under a condition of soot contamination, as phosphorous content, is 0.01 mass % or more, preferably 0.02 mass % or more, and particularly preferably 0.04 mass % or more.

When dosage of phosphorus-containing anti-wear agent is more than 0.2 mass % as phosphorous content, high-temperature detergency and property of base-number retention are seriously deteriorated, thus it is not preferable. Meanwhile, dosage of 0.09~0.2 mass % is preferable in view of insignificant wear under the condition of soot mixing; nevertheless, so as to further minimize sulfur and phosphorus, or to enhance high-temperature detergency and property of base-number retention, it is desirably 0.08 mass % or less.

<(C) Component>

(C) component of the first embodiment of the lubricating oil composition is a metallic detergent. Specifically, it may be sulfonate detergent, phenate detergent, salicylate detergent, and carboxylate detergent; any one of these can be used. In the invention, in view of particularly superior anti-wear property under a condition of soot contamination, using sulfonate detergent is particularly preferable.

As the sulfonate detergent, the structure is not particularly limited. The example thereof may be alkali metal salt or alkali earth metal salt of alkyl aromatic sulfonic acid obtained by sulfonation of alkyl aromatic compounds of molecular weight 100~1500, preferably 200~700, particularly magnesium salt and/or calcium salt are preferably used; as the alkyl aromatic sulfonic acid, specifically, there may be the so-called "petroleum sulfonate" and "synthetic sulfonate". As the petroleum sulfonate, in general, a compound obtained by sulfonation of alkyl aromatic compounds of mineral lubricating oil fraction or the so-called "mahogany acid" and the like obtained as a by-product in the manufacturing of white oil. On the other hand, as the synthetic sulfonate, for example, a material obtained by that alkylbenzene having straight-chain or branched alkyl group, which is obtained as a by-product from plant manufacturing alkylbenzene for the raw material of detergent or obtained by alkylation of polyolefin into benzene, is used as a raw material and the alkylbenzene is sulfonated; or another material obtained by sulfonating dinonylnaphthalene. In addition, as sulfonating agents to sulfonate these alkyl aromatic compounds are not particularly limited; usually, fuming sulfuric acid and sulfate are used.

For alkylation of the aromatic sulfonic acid, straight-chain or branched (poly)olefin, e.g., oligomer of olefin of carbon number 2~4 like ethylene, propylene, and butane are preferably used. Among them, ethylene oligomer is particularly preferably used. The alkali metal salt or alkali earth metal salt of the alkylated alkyl aromatic sulfonic acid using ethylene oligomer especially enables to enhance the friction reducing effect.

Examples of sulfonate detergent include neutral alkali earth metal sulfonate, obtained by making the above alkyl aromatic sulfonic acid directly react with alkali earth metal base such as oxide or hydroxide of alkali earth metal like magnesium and/or calcium, or obtained by making the above alkyl aromatic sulfonic acid once convert into alkali metal salt such as sodium salt and potassium salt and then substituting the alkali metal salt for alkali earth metal salt. The examples of sulfonate detergent also include basic alkali earth metal sulfonate obtained by heating a mixture of the above neutral alkali earth metal sulfonate and excessive alkali earth metal salt or alkali earth metal base (hydroxide and oxide) under existence of water; carboxylate over-based alkali earth metal sulfonate, and borate over-based alkali earth metal sulfonate, both of which can be obtained by making the above neutral alkali earth metal sulfonate react with base of alkali earth metal under existence of carbon dioxide and/or boric acid or borate.

As the sulfonate detergent of the invention, the above neutral alkali earth metal sulfonate, basic alkali earth metal sulfonate, over-based alkali earth metal sulfonate, and mixture thereof may be used.

As the sulfonate detergent of the invention, calcium sulfonate detergent and magnesium sulfonate detergent are preferably used, using calcium sulfonate detergent is particularly preferable.

The sulfonate detergent is usually commercially-supplied and available in a form diluted with light lubricant base oil and the like. In general, a sulfonate detergent of which metal content is 1.0~20 mass %, preferably 2.0~16 mass % is desirably used.

The base-number of the sulfonate detergent to be used for the invention is arbitrary; it is normally 0~500 mgKOH/g, in view of superior high-temperature detergency improving effect per content, a sulfonate detergent of which base-number is 100~450 mgKOH/g, preferably 200~400 mgKOH/g is desirably used.

Here, "base-number" means a base-number based on perchloric acid method measured in accordance with No. 7 in JIS K 2501 "Petroleum products and lubricating oil—Determination of neutralization number".

As the salicylate detergent, the structure thereof is not particularly limited; metal salt of salicylic acid having one or two alkyl group of carbon number 1~40, preferably alkali metal salt or alkali earth metal salt, particularly magnesium salt and/or calcium salt are preferably used.

As the salicylate detergent to be used for the lubricating oil composition of the invention, in view of superior property of low-temperature viscosity, monoalkyl salicylic acid metal salt of which component ratio is higher is preferable. For instance, it is preferably alkyl salicylic acid metal salt, and/or (per) basic salt thereof, wherein component ratio of monoalkyl salicylic acid metal salt is 85~100 mol %, component ratio of dialkyl salicylic acid metal salt is 0~15 mol %, and component ratio of 3-alkyl salicylic acid metal salt is 40~100 mol %. Further, as the salicylate detergent of the invention, in view of superior high-temperature detergency and property of base-number retention, a salicylate detergent containing dialkyl salicylic acid metal salt is preferable.

Here, "monoalkyl salicylic acid metal salt" means alkyl salicylic acid metal salt having one alkyl group such as 3-alkyl salicylic acid metal salt, 4-alkyl salicylic acid metal salt, and 5-alkyl salicylic acid metal salt. The component ratio of monoalkyl salicylic acid metal salt, to 100 mol % of alkyl salicylic acid metal salt, is 85~100 mol %, preferably 88~98 mol %, and more preferably 90~95 mol %; the component ratio of alkyl salicylic acid metal salt other than the monoalkyl salicylic acid metal salt, e.g., component ratio of dialkyl salicylic acid metal salt, is 0~15 mol %, preferably 2~12 mol %, and more preferably 5~10 mol %. Further, component ratio of 3-alkyl salicylic acid metal salt, to 100 mol % of alkyl salicylic acid metal salt, is 40~100 mol %, preferably 45~80 mol %, and more preferably 50~60 mol %. The component ratio of sum of 4-alkyl salicylic acid metal salt and 5-alkyl salicylic acid metal salt, to 100 mol % of alkyl salicylic acid metal salt, is equivalent to the component ratio where the component ratios of the above 3-alkyl salicylic acid metal salt, dialkyl salicylic acid metal salt are subtracted, namely, it is 0~60 mol %, preferably 20~50 mol %, more preferably 30~45 mol %. If small dosage of dialkyl salicylic acid metal salt is contained, it is capable to obtain a composition which is excellent in high-temperature detergency, low-temperature properties, and property of base-number retention. By setting the component ratio of 3-alkylsalicylate at 40 mol % or more, it is capable to make the component ratio of 5-alkyl salicylic acid metal salt relatively lower and to improve the oil solubility.

Furthermore, examples of alkyl group of alkyl salicylic acid metal salt constituting the salicylate detergent include: alkyl group of carbon number 10~40, preferably carbon number 10~19 or carbon number 20~30; more preferably alkyl group of carbon number 14~18 or carbon number 20~26; and particularly preferably alkyl group of carbon number 14~18. The alkyl group of carbon number 10~40 include: decyl, undecyl, dodecyl, tridecyl, tetradecyl, pentadecyl, hexadecyl, heptadecyl, octadecyl, nonadecyl, icosyl, henicosyl, docosyl, tricosyl, tetracosyl, pentacosyl, hexacosyl, heptacosyl, octacosyl, nonacosyl, and triacontyl. These alkyl groups may be straight-chain or branched; these also may be primary alkyl group, secondary alkyl group, or tertiary alkyl group; in the present invention, in order to easily obtain the above desired salicylic acid metal salt, secondary alkyl group is particularly preferable.

Examples of metal for alkyl salicylic acid metal salt include alkali metal such as sodium and potassium, also alkali earth metal such as calcium and magnesium. Among them, calcium and magnesium are preferable, and calcium is particularly preferable.

The salicylate detergent can be manufactured by a conventional method, and it is not particularly limited. For example, it is obtained by alkylation of olefin of carbon number 10~40 such as polymer or copolymer consisting of 1 mole or more (to 1 mole of phenol) of ethylene, propylene, butene, and the like, preferably straight-chain α-olefin like ethylene polymer, and by carboxylation of the olefin using carbon dioxide gas thereafter; or it is also obtained by reacting alkyl salicylic acid having monoalkyl salicylic acid obtained by the method alkylating the above 1 mole or more (to 1 mole of salicylic acid) of the olefin, preferably the straight-chain α-olefin as a main component with metallic base such as oxide and hydroxide and the like of alkali metal or alkali earth metal, or by making the alkyl salicylic acid be converted into an alkali metal salt such as sodium salt and potassium salt, or further by substituting the alkali metal salt with alkali earth metal salt. Here, by controlling the response rate of phenol or salicylic acid with olefin to preferably e.g., 1:1~1.15 (mole ratio), more preferably 1:1.05~1.1 (mole ratio), it is capable to control the component ratio between monoalkyl salicylic acid metal salt and dialkyl salicylic acid metal salt to the desirable ratio. In addition, by using straight-chain α-olefin as an olefin, it is capable to control the component ratio among 3-alkyl salicylic acid metal salt, 5-alkyl salicylic acid metal salt, and the like to the desirable ratio and capable to obtain an alkyl salicylic acid metal salt, which is preferable for the present invention, having secondary alkyl as a main component; thereby it is particularly preferable. When branched olefin is used as an olefin, mostly, 5-alkyl salicylic acid metal salt only is obtained. However, in order to have the desirable constitution of the invention, 3-alkyl salicylic acid metal salt and the like must be mixed for improving the oil solubility that diversify the manufacturing process, thus it is not preferable.

The salicylate detergent suitably used for the lubricating oil composition of the invention may be a basic salt obtained by adding further excessive alkali metal salt or alkali earth metal salt or alkali metal base or alkali earth metal base (hydroxide or oxide of alkali metal or alkali earth metal) to the alkali metal salicylate or alkali earth metal salicylate (neutral salt) obtained in the above manner and heating this under existence of water, or it may be an over-based salt obtained by reacting the above neutral salt with a base such as hydroxide of alkali metal or alkali earth metal under existence of carbon dioxide and/or boric acid or borate.

These reactions are usually carried out in solvent (e.g., aliphatic hydrocarbon solvent like hexane, aromatic hydrocarbon solvent like xylene, and light lubricant base oil, etc.), and the metal content is preferable 1.0~20 mass %, preferably 2.0~16 mass %.

As the most preferable salicylate detergent used for the invention, in view of superior balance among high-temperature detergency, property of base-number retention, and property of low-temperature viscosity, it is alkyl salicylic acid metal salt, and/or the (per) basic salt thereof of which component ratio of: monoalkyl salicylic acid metal salt is 85~95 mol %, dialkyl salicylic acid metal salt is 5~15 mol %, 3-alkyl salicylic acid metal salt is 50~60 mol %, and sum of 4-alkyl salicylic acid metal salt and 5-alkyl salicylic acid metal salt is 35~45 mol %. The alkyl group in the above is particularly preferably secondary alkyl group.

In the invention, base-number of the salicylate detergent is normally 0~500 mgKOH/g, preferably 20~300 mgKOH/g, and particularly preferably 100~200 mgKOH/g; one or a combination of two or more selected from the above can be used. The "base-number" means a base-number based on perchloric acid method, a method measured in accordance with No. 7 in JIS K 2501 "Petroleum products and lubricating oil—Determination of neutralization number".

As the phenate detergent, specifically, alkylphenol sulfide obtained by reacting alkylphenol having at least one straight-chain or branched alkyl group of carbon number 4~40, preferably carbon number 6~18 with sulfur; or alkali earth metal salt, particularly magnesium salt and/or calcium salt, and so on, which is a product of Mannich reaction of alkylphenol, obtained by reacting this alkylphenol with formaldehyde, are preferably used.

Examples of the phenate detergent include: a basic salt obtained by adding further excessive alkali metal salt or alkali earth metal salt and alkali metal base or alkali earth metal base (hydroxide or oxide of alkali metal or alkali earth metal) to alkali metal phenate or alkali earth metal phenate (neutral salt) obtained in the above manner and heating this under existence of water; and it may be an over-based salt obtained by reacting the above neutral salt with a base such as hydroxide of alkali metal or alkali earth metal under existence of carbon dioxide and/or boric acid or borate.

These reactions are usually carried out in solvent (e.g., aliphatic hydrocarbon solvent like hexane, aromatic hydrocarbon solvent like xylene, and light lubricant base oil, etc.), and the metal content is preferable 1.0~20 mass %, preferably 2.0~16 mass %.

The base-number of the phenate detergent is normally 0~500 mgKOH/g, preferably 20~450 mgKOH/g.

The metal ratio of these metallic detergent is not particularly limited. It is usually 1~40; meanwhile, in the invention, in view of possibility to easily inhibit wear under a condition of soot contamination, it is preferable to blend at least one of these metallic detergent of which metal ratio is preferably 2 or more, more preferably 3 or more, particularly preferably 6 or more. Moreover, in view of stability, the metal ratio is preferably 20 or less, more preferably 15 or less. The "metal ratio" is represented by: (valency of metal element in the metallic detergent)×(metal-element content (mol %))/(soap content (mol %)). The "soap" means an opponent organic group forming metal salt, it may be sulfonic acid-containing group, salicylic acid-containing group, and phenol-containing group.

In the invention, in view of excellent anti-wear property under a condition of soot contamination, sulfonate detergent and/or phenate detergent of which metal ratio is 6 or more, preferably 8~15 are preferably contained. Further, in view of possibility to improve low-friction property and high-temperature detergency, metallic detergent of which metal ratio is less than 2, preferably 1.5 or less are desirably contained. Among them, sulfonate detergent and/or salicylate detergent, particularly sulfonate detergent are desirably contained. Combining the above sulfonate detergent and/or phenate detergent of which metal ratio is 6 or more and the above sulfonate detergent and/or salicylate detergent of which metal ratio less than 2 is more desirable; and combining a sulfonate detergent of which metal ratio is 6 or more and a sulfonate detergent of which metal ratio is less than 2 is particularly preferable.

In the lubricating oil composition of the invention, dosage of (C) component to total mass of the lubricating oil composition, as metal content, is 0.01~1 mass %, preferably 0.05~0.5 mass %, more preferably 0.1~0.3 mass %, and particularly preferably 0.15~0.25 mass %.

Also, as (C) component, when a combination of the above sulfonate detergent and/or phenate detergent of which metal ratio is 6 or more and the above sulfonate detergent and/or salicylate detergent of which metal ratio is less than 2 is contained, content ratio thereof is not particularly limited. However, according to the above reason, as mass ratio (M2/(M1+M2)), i.e. ratio of metal content (M2) attributed to the above sulfonate detergent and/or salicylate detergent of which metal ratio is less than 2 to total mass of metal content (M1) attributed to the above sulfonate detergent and/or phenate detergent of which metal ratio is 6 or more and metal content (M2) attributed to the above sulfonate detergent and/or salicylate detergent of which metal ratio is less than 2, it is preferably 0.001~0.5, more preferably 0.01~0.3, further preferably 0.05~0.2, and particularly preferably 0.08~0.12.

<(C') Component>

(C') component in the lubricating oil composition of the second embodiment of the invention is a metallic detergent of which metal ratio is prepared to become 3.0 or more; it contains at least (C1) sulfonate detergent.

As the metal ratio of (C') component, in view of excellent anti-wear property under a condition of soot contamination, it must be prepared to become 3.0 or more, it is preferably 4.0 or more, and further preferably 5.0 or more. In view of superior friction reducing effect or high-temperature detergency improving effect, it is also desirably prepared to be preferably 20 or less, more preferably 10 or less, further preferably 8 or less, particularly preferably 6 or less. The "metal ratio" is represented by: (valency of metal element in the metallic detergent)×(metal-element content (mol %))/(soap content (mol %)). The "soap" means an opponent organic group forming metal salt, it may be sulfonic acid-containing group, salicylic acid-containing group, and phenol-containing group.

As the sulfonate detergent (C1), the structure thereof is not particularly limited. Examples thereof may be alkali metal salt or alkali earth metal salt of alkyl aromatic sulfonic acid obtained by sulfonation of alkyl aromatic compounds of which molecular weight 100~1500, preferably 200~700, particularly preferably magnesium salt and/or calcium salt. Specific example of the alkyl aromatic sulfonic acid is the so-called "petroleum sulfonic acid", "synthetic sulfonic acid", and the like. As the petroleum sulfonic acid, in general, a compound obtained by sulfonation of alkyl aromatic compounds of lubricating oil fraction of mineral oil, or the so-called "mahogany acid" or the like obtained as a by-product in the manufacturing process of white oil. Further, as the synthetic sulfonic acid, there may be a material obtained by that alkylbenzene having straight-chain or branched alkyl group, which is obtained as a by-product from plant manufacturing alkylbenzene for the raw material of detergent or obtained by alkylation of polyolefin into benzene, is used as a raw material and the alkylbenzene is sulfonated, or another material obtained by sulfonating dinonylnaphthalene. In addition, as sulfonating agents to sulfonate these alkyl aromatic compounds are not particularly limited; usually, fuming sulfuric acid and sulfate are used.

For the alkylation of aromatic sulfonic acid, straight-chain or branched (poly)olefin, for example, oligomer of olefin of carbon number 2~4 such as ethylene, propylene, and butane is preferably used, among them, ethylene oligomer is particularly preferably used. Alkali metal salt or alkali earth metal salt of alkyl aromatic sulfonic acid which is alkylated by ethylene oligomer particularly enables to enhance friction reducing effect.

As the sulfonate detergent, the examples include not only neutral alkali earth metal sulfonate obtained by directly reacting the above alkyl aromatic sulfonic acid with alkali earth metal base such as oxide or hydroxide of alkali earth metal like magnesium and/or calcium or obtained by once converting the above alkyl aromatic sulfonic acid to alkali salt like sodium salt and potassium salt and substituting the alkali salt with alkali earth metal salt; but also basic alkali earth metal sulfonate obtained by heating a mixture of the above neutral alkali earth metal sulfonate and excessive alkali earth metal salt or alkali earth metal base (hydroxide and oxide) under existence of water; and carboxylate over-based alkali earth metal sulfonate, and borate over-based alkali earth metal sulfonate, both of which can be obtained by making the above neutral alkali earth metal sulfonate react with base of alkali earth metal under existence of carbon dioxide and/or boric acid or borate.

As the sulfonate detergent (C1) in the invention, the above neutral alkali earth metal sulfonate, basic alkali earth metal sulfonate, over-based alkali earth metal sulfonate, and mixture thereof may be used.

As the sulfonate detergent (C1) of the invention, using calcium sulfonate detergent and magnesium sulfonate detergent preferable, using calcium sulfonate detergent is particularly preferable.

The sulfonate detergent is usually commercially-supplied and available in a form diluted with light lubricant base oil and the like. In general, a sulfonate detergent of which the metal content is 1.0~20 mass %, preferably 2.0~16 mass % is desirably used.

The base-number of the sulfonate detergent (C1) to be used for the invention is arbitorary; it is normally 0~500 mgKOH/g, in view of superior high-temperature detergency improving effect per content, a sulfonate detergent of which base-number is 100~450 mgKOH/g, preferably 200~400 mgKOH/g is desirably used.

The "base-number" means a base-number based on perchloric acid method, a method measured in accordance with No. 7 in JIS K 2501 "Petroleum products and lubricating oil—Determination of neutralization number".

In the invention, as metallic detergent (C'), other metallic detergents may be used together with the sulfonate detergent (C1), such metallic detergents include phenate detergent (C2) and salicylate detergent (C3); either of them can be used.

As the phenate detergent (C2), specifically, alkylphenol sulfide obtained by reacting alkylphenol having at least one straight-chain or branched alkyl group of carbon number 4~40, preferably carbon number 6~18 with sulfur; or alkali earth metal salt, particularly magnesium salt and/or calcium salt, and so on, which is a product of Mannich reaction of alkylphenol obtained by reacting this alkylphenol with formaldehyde, are preferably used.

Examples of the phenate detergent (C2) include: a basic salt obtained by adding further excessive alkali metal salt or alkali earth metal salt and alkali metal base or alkali earth metal base (hydroxide or oxide of alkali metal or alkali earth metal) to alkali metal phenate or alkali earth metal phenate (neutral salt) obtained in the above manner and heating this under existence of water; and an over-based salt obtained by reacting the above neutral salt with a base such as hydroxide of alkali metal or alkali earth metal under existence of carbon dioxide and/or boric acid or borate.

These reactions are usually carried out in solvent (aliphatic hydrocarbon solvent like hexane, aromatic hydrocarbon solvent like xylene, and light lubricant base oil, etc.), and the metal content is preferable 1.0~20 mass %, preferably 2.0~16 mass %.

The base-number of the phenate detergent (C2) to be used is normally 0~500 mgKOH/g, preferably 20~450 mgKOH/g.

The structure of the salicylate detergent (C3) is not specifically limited; metal salt of salicylic acid having one or two alkyl group of carbon number 1~40, preferably alkali metal salt or alkali earth metal salt, particularly magnesium salt and/or calcium salt are preferably used.

As the salicylate detergent (C3) used for the lubricating oil composition of the invention, in view of superior property of low-temperature viscosity, monoalkyl salicylic acid metal salt of which component ratio is higher is preferable. For instance, it is preferably alkyl salicylic acid metal salt, and/or (per) basic salt thereof, wherein component ratio of monoalkyl salicylic acid metal salt is 85~100 mol %, component ratio of dialkyl salicylic acid metal salt is 0~15 mol %, and component ratio of 3-alkyl salicylic acid metal salt is 40~100 mol %. Further, as the salicylate detergent (C3) of the invention, in view of superior high-temperature detergency and property of base-number retention, a salicylate detergent containing dialkyl salicylic acid metal salt is preferable.

Here, "monoalkyl salicylic acid metal salt" means alkyl salicylic acid metal salt having one alkyl group such as 3-alkyl salicylic acid metal salt, 4-alkyl salicylic acid metal salt, and 5-alkyl salicylic acid metal salt. The component ratio of monoalkyl salicylic acid metal salt, to 100 mol % of alkyl salicylic acid metal salt, is 85~100 mol %, preferably 88~98 mol %, and more preferably 90~95 mol %; the component ratio of alkyl salicylic acid metal salt other than the monoalkyl salicylic acid metal salt, e.g., component ratio of dialkyl salicylic acid metal salt, is 0~15 mol %, preferably 2~12 mol %, and more preferably 5~10 mol %. Further, component ratio of 3-alkyl salicylic acid metal salt, to 100 mol % of alkyl salicylic acid metal salt, is 40~100 mol %, preferably 45~80 mol %, and more preferably 50~60 mol %. The component ratio of sum of 4-alkyl salicylic acid metal salt and 5-alkyl salicylic acid metal salt, to 100 mol % of alkyl salicylic acid metal salt, is equivalent to the component ratio where the component ratios of the above 3-alkyl salicylic acid metal salt and dialkyl salicylic acid metal salt are subtracted, namely, 0~60 mol %, preferably 20~50 mol %, more preferably 30~45 mol %. If small dosage of dialkyl salicylic acid metal salt is contained, it is capable to obtain a composition which is excellent in high-temperature detergency, low-temperature properties, and property of base-number retention. By setting the component ratio of 3-alkylsalicylate at 40 mol % or more, it is capable to relatively lower the component ratio of 5-alkyl salicylic acid metal salt, which improves the oil solubility of the composition.

Furthermore, examples of alkyl group of alkyl salicylic acid metal salt constituting the salicylate detergent (C3) include: alkyl group of carbon number 10~40, preferably carbon number 10~19 or carbon number 20~30; more preferably alkyl group of carbon number 14~18 or carbon number 20~26; and particularly preferably alkyl group of carbon number 14~18. The alkyl group of carbon number 10~40 include: decyl, undecyl, dodecyl, tridecyl, tetradecyl, pentadecyl, hexadecyl, heptadecyl, octadecyl, nonadecyl, icosyl, henicosyl, docosyl, tricosyl, tetracosyl, pentacosyl, hexacosyl, heptacosyl, octacosyl, nonacosyl, and triacontyl. These alkyl groups may be straight-chain or branched; these also may be primary alkyl group, secondary alkyl group, or tertiary alkyl group. In the present invention, in view of possibility to easily obtain the above desired salicylic acid metal salt, secondary alkyl group is particularly preferable.

Examples of metal for alkyl salicylic acid metal salt are preferably alkali metal such as sodium and potassium, also alkali earth metal such as calcium and magnesium. Among them, calcium and magnesium are preferable, and calcium is particularly preferable.

The salicylate detergent (C3) can be manufactured by a conventional method, and it is not particularly limited. For example, it is obtained by alkylation of olefin of carbon number 10~40 such as polymer or copolymer consisting of 1 mole or more (to 1 mole of phenol) of ethylene, propylene, butene, and the like, preferably straight-chain α-olefin like ethylene polymer, and by carboxylation using carbon dioxide gas thereafter; or it is also obtained by reacting alkyl salicylic acid having monoalkyl salicylic acid as a main component obtained by the method alkylating the 1 mole or more (to 1 mole of salicylic acid) of the olefin, preferably the straight-chain α-olefin with metallic base such as oxide or hydroxide, or the like, of alkali metal or alkali earth metal, or by converting the alkyl salicylic acid into an alkali metal salt such as sodium salt and potassium salt, or further by substituting the alkali metal salt with alkali earth metal salt. Here, by controlling the response rate of phenol or salicylic acid with olefin to preferably e.g., 1:1~1.15 (mole ratio), more preferably 1:1.05~1.1 (mole ratio), it is capable to control the component ratio between monoalkyl salicylic acid metal salt and dialkyl salicylic acid metal salt to the desirable ratio. In addition, by using straight-chain α-olefin as an olefin, it is capable to control the component ratio among 3-alkyl salicylic acid metal salt, 5-alkyl salicylic acid metal salt, and so on to the desirable ratio and capable to obtain an alkyl salicylic acid metal salt having secondary alkyl as a main component which is preferable for the present invention; thereby it is particularly preferable. When branched olefin is used as an olefin, mostly, 5-alkyl salicylic acid metal salt only is obtained. However, in order to have the desirable constitution of the invention, 3-alkyl salicylic acid metal salt and the like must be mixed for improving the oil solubility, which diversify the manufacturing process, thus it is not preferable.

Examples of the salicylate detergent (C3) include: a basic salt obtained by adding further excessive alkali metal salt or alkali earth metal salt and alkali metal base or alkali earth metal base (hydroxide or oxide of alkali metal or alkali earth metal) to alkali metal salicylate or alkali earth metal salicylate (neutral salt) obtained in the above manner and heating this under existence of water; and an over-based salt obtained by reacting the above neutral salt with a base such as hydroxide of alkali metal or alkali earth metal under existence of carbon dioxide and/or boric acid or borate.

These reactions are usually carried out in solvent (e.g., aliphatic hydrocarbon solvent like hexane, aromatic hydrocarbon solvent like xylene, and light lubricant base oil, etc.), and the metal content is preferable 1.0~20 mass %, preferably 2.0~16 mass %.

As the most preferable salicylate detergent (C3) used for the invention, in view of superior balance among high-temperature detergency, property of base-number retention, and property of low-temperature viscosity, it is alkyl salicylic acid metal salt, and/or the (per) basic salt thereof of which component ratio of: monoalkyl salicylic acid metal salt is 85~95 mol %, dialkyl salicylic acid metal salt is 5~15 mol %, 3-alkyl salicylic acid metal salt is 50~60 mol %, and sum of 4-alkyl salicylic acid metal salt and 5-alkyl salicylic acid metal salt is 35~45 mol %. The alkyl group in the above is particularly preferably secondary alkyl group.

In the invention, base-number of the salicylate detergent is normally 0~500 mgKOH/g, preferably 20~300 mgKOH/g, and particularly preferably 100~200 mgKOH/g; one or a combination of two or more selected from the above can be used. The "base-number" means a base-number based on perchloric acid method, a method measured in accordance with No. 7 in JIS K 2501 "Petroleum products and lubricating oil—Determination of neutralization number".

As metallic detergent (C') to be used for the invention, as long as it contains the sulfonate detergent (C1) and the metal ratio thereof is prepared to be 3.0 or more, the combination is not limited. It may be a single sulfonate detergent or a combination of two or more; for example, single sulfonate detergent of which metal ratio is 3.0 or more may be used, or the single sulfonate detergent may be prepared with the above-listed other metallic detergent such that the metal ratio becomes 3.0 or more. Further, as the metallic detergent (C'), for instance, it may be prepared to make the metal ratio become 3.0 or more using a combination of sulfonate detergent of which metal ratio is less than 3.0 and the above-listed other metallic detergent.

In the invention, as (C') component, it is desirably a combination of sulfonate detergent (C1a) of which metal ratio is less than 2 and/or phenate detergent (C2a) of which metal ratio is less than 2 together with sulfonate detergent (C1b) of which metal ratio is 6 or more; it is particularly desirably a combination of sulfonate detergent (C1a) of which metal ratio is less than 2 and sulfonate detergent (C1b) of which metal ratio is 6 or more.

Also, as the metal ratio of (C') component as mentioned above, in view of superior anti-wear property under a condition of soot contamination, it is at least 3.0 or more, it is preferably 4.0 or more, and more preferably 5.0 or more; in view of superior friction reducing effect or high-temperature detergency improving effect, it is desirably prepared to become preferably 20 or less, more preferably 10 or less, further preferably 8 or less, and particularly preferably 6 or less. Meanwhile, metal ratio of (C') component when the (C') component is a mixture of a plurality of metallic detergents is represented by:

((total) metal content (mol %) attributed to (each) metallic detergent)×(valency of metal in (each) metallic detergent)/((total) soap content (mol %) attributed to (each) metallic detergent).

In the lubricating oil composition of the second embodiment of the invention, content of the (C') component as the metal content, to total mass of the lubricating oil composition, is 0.01~1 mass %, preferably 0.05~0.5 mass %, more preferably 0.1~0.3 mass %, and furthermore preferably 0.15~0.25 mass %.

<(D) Component>

(D) component of the first and second embodiments of the invention is ashless dispersant. Examples of ashless dispersant include: nitrogen-containing compound such as succinimide, benzylamine, polyamine, and Mannich base respectively having alkenyl group or alkyl group derived from polyolefin; and the derivatives thereof by reacting these nitrogen-containing compound with boron compound such as boric acid and borate, phosphorous compound such as (thio) phosphoric acid and (thio) phosphate, organic acid, hydroxyl (poly)oxyalkylene carbonate, and so on.

In the invention, one or more selected from the above can be blended. The alkenyl group or alkyl group may be straight-chain or branched. Preferable examples, specifically, include: oligomer of olefin such as propylene, 1-butene, and isobutylene; branched alkyl group and branched alkenyl group, and so on derived from a co-oligomer of ethylene and propylene; and so on. These are preferably branched alkyl group or branched alkenyl group derived from polybutene (polyisobutene) of which number average molecular weight is 700~5000, particularly 900~5000.

Weight-average molecular weight of the ashless dispersant used for the invention is at least 3000~20000, it is preferably 4000~15000. If the weight-average molecular weight is less than 3000, molecular weight of polybutenyl of nonpolar group is small thereby the dispersion of sludge is inferior, further, amine portion of polar group, which possibly becomes active spot of oxidation degradation, is relatively increased and that makes the oxidation stability thereof inferior; thus it is not preferable. Meanwhile, in view of inhibiting deterioration of property of low-temperature viscosity, the weight-average molecular weight is preferably 20000 or less, and particularly preferably 15000 or less. Here, the "weight-average molecular weight" means a polystyrene equivalent weight-average molecular weight obtained by using two columns of GMHHR-M manufactured by Tosoh Corporation (7.8 mm ID×30 cm) set in series in 150-CALC/GPC apparatus manufactured by Waters Corporation, and measured by Refractive Index detector (RI) with tetrahydrofuran as a solvent, under a condition of temperature at 23° C., velocity of flow at 1 mL/min, sample concentration: 1 mass %, and injection quantity of the sample: 75 μL.

Example of the ashless dispersant suitably used for the lubricating oil composition of the invention may be polybutenyl succinimide represented by the following general formulas (10) or (11).

(General formula 10)

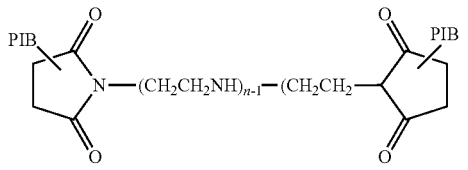

(10)

(General formula 11)

-continued (11)

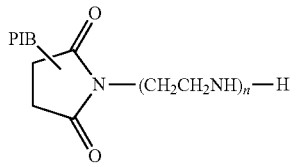

PIB in the general formulas (10) and (11) indicate polybutenyl, it is obtained by polybutene which is obtained by polymerizing high-purity isobutene or a mixture of 1-butene and isobutene with fluoroboric catalyst or aluminum-chloride catalyst. In the polybutene mixture, 5~100 mol % of PIB having vinylidene structure at the terminal is normally contained. In view of superior sludge inhibiting effect, "n" is desirably integer number of 2~5, preferably integer number of 3~4.

Manufacturing method of the succinimide represented by the general formula (10) or (11) is not particularly limited. For example, it is obtained by reacting a compound which is obtained by chlorinating the above polybutene, the compound is preferably high-reactive polybutene (polyisobutene) by polymerizing the above high-purity isobutene with fluoboric catalyst, and more preferably, polybutenyl succinic acid obtained by reacting polybutene (where chloride and fluorine are sufficiently removed) with maleic anhydride at 100~200° C., with polyamine such as diethylene triamine, triethylene tetramine, tetraethylene pentamine, and pentaethylene hexamine.

When bissuccinimide is manufactured, dosage of the polybutenyl succinic acid may be twice (mol ratio) of polyamine. When monosuccinimide is manufactured, the polybutenyl succinic acid and polyamine may be reacted in equal proportions (mol ratio). Among these, in view of superior sludge dispersancy, polybutenylbis succinimide is preferable.

In the polybutene used for the above manufacturing method, minute amount of fluorine and chloride attributed to the catalyst in the manufacturing process is possibly remained, so polybutene in which fluorine portion and chloride portion are sufficiently removed by an adequate way like adsorption method and thorough water-washing is preferably used. As the content of fluorine and chloride, it is preferably 50 mass ppm or less, more preferably 10 mass ppm or less, further preferably 5 mass ppm or less, and particularly preferably 1 mass ppm or less.

Moreover, in a process for obtaining polybutenyl succinic anhydride by a reaction of polybutene and maleic anhydride, conventionally, chlorination using chloride is usually used. However, by this method, large amount of chloride (e.g., approximately 2000~3000 ppm) remains in the succinimide final product. On the other hand, a method without using chloride, for example, a method using the above high-purity polybutene and/or method of thermal reaction, can inhibit chloride remaining in the final product down to extremely low level (e.g., 0~30 ppm) Accordingly, in order to inhibit chloride content in the lubricating oil composition to the range of 0~30 weight ppm, chloride method should not be used, but polybutenyl succinic anhydride obtained by a method using the above high-reactive polybutene and/or thermal reaction is preferably used.

As derivatives of polybutenyl succinimide, compound represented by the above general formula (10) or (11) is reacted with boron compound such as boric acid, and oxygen-containing organic compound such as alcohol, aldehyde, ketone, alkylphenol, cyclic carbonate, and organic acid to use the reaction product as the so-called "modified succinimide" which a part of or all of remaining amino group and/or imino group are neutralized or amidated. Especially, boron-containing alkenyl (or alkyl) succinimide obtained by reaction with boron compound like boric acid is advantageous in thermal-oxidation stability.

As boron compound to be reacted with a compound represented by the general formula (10) or (11) may be boric acid, borate, boric acid ester, and so on.

As boric acid, specific examples include orthoboric acid, metaboric acid, and tetra-boric acid.

Examples of borate include alkali metal salt, alkali earth metal salt, or ammonium salt of borate; more specifically, lithium borate such as lithium metaborate, lithium tetraborate, lithium pentaborate, and lithium perborate; sodium borate such as sodium metaborate, sodium diborate, sodium tetraborate, sodium pentaborate, sodium hexaborate, and sodium octaborate; potassium borate such as potassium metaborate, potassium tetraborate, potassium pentaborate, potassium hexaborate, and potassium octaborate; calcium borate such as calcium metaborate, calcium diborate, tricalcium tetraborate, pentacalcium tetraborate, and calcium hexaborate; magnesium borate such as magnesium metaborate, magnesium diborate, trimagnesium tetraborate, pentamagnesium tetraborate, and magnesium hexaborate; and ammonium borate such as ammonium metaborate, ammonium tetraborate, ammonium pentaborate, and ammonium octaborate.

In addition, borate ester may be ester of borate and preferably alkylalcohol of carbon number 1~6, more specific examples include monomethyl borate, dimethyl borate, trimethyl borate, monoethyl borate, diethyl borate, triethyl borate, monopropyl borate, dipropyl borate, tripropyl borate, monobutyl borate, dibutyl borate, and tributyl borate.

The succinimide derivatives reacted with the above boron compound is suitably used in view of its excellent heat-resistance and oxidation stability.

Specific examples of oxygen-containing organic compound to be reacted with compounds represented by the general formula (10) or (11) include: monocarboxylic acid of carbon number 1~30 such as formic acid, acetic acid, glycolic acid, propionic acid, lactic acid, butyric acid, valeric acid, caproic acid, enanthic acid, caprylic acid, pelargonic acid, capric acid, undecylic acid, lauric acid, tridecanoic acid, myristic acid, pentadecanoic acid, palmitic acid, margaric acid, stearic acid, oleic acid, nonadecanoic acid, and eicosanic acid; polycarboxylic acid of carbon number 2~30 such as oxalic acid, phthalic acid, trimellitic acid, and pyromellitic acid, or anhydride thereof or ester compound thereof; and alkyleneoxide of carbon number 2~6 such as hydroxy (poly) oxyalkylene carbonate.

By reacting such an oxygen-containing organic compound, for example, presumably, a part of or all of amino group or imino group in the compound represented by the general formula (10) or (11) may become a structure shown by the following general formula (12).

(General formula 12)

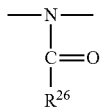

(12)

In the above general formula (12), $R^{26}$ is hydrogen atom, alkyl group of carbon number 1~24, alkenyl group of carbon number 1~24, alkoxy group of carbon number 1~24, or hydroxy(poly)oxyalkylene group represented by: —O—$(R^{27}O)_m$H; $R^{27}$ is alkylene group of carbon number 1~4; and "m" is integer number of 1~5. Among them, polybutenyl bis-succinimide having a compound, as the main component, obtained by reacting all of amino group or imino group with the oxygen-containing organic compound is preferably used in view of superior sludge dispersancy. Such a compound can be obtained by, e.g. reacting 1 mole of compound shown by general formula (10) with e.g. 0.5~(n−1) mole, preferably (n−1) mole of oxygen-containing organic compound. Succinimide derivatives reacted with such an oxygen-containing organic compound is preferable since it is excellent in sludge dispersiveness, the one reacted with hydroxy(poly)oxyalkylene carbonate is particularly preferable.

A preferable embodiment in a situation where the lubricating oil composition of the invention is made to contain ashless dispersant, (D1) ashless dispersant of which weight-average molecular weight is 6500 or more and/or (D2) boron-containing ashless dispersant of which weight-average molecular weight is 3000 or more are preferably contained. So as to significantly lower the wear under a condition of soot contamination and to enable to obtain a composition which has excellent high-temperature detergency, the above (D1) and (D2) are preferably used at the same time. Among the ashless dispersants, it may be the above polybutenyl succinimide and the derivatives thereof, and particularly bis-type thereof is preferable.

Weight-average molecular weight of (D1) component is 6500~20000, preferably 8000 or more, more preferably 9000 or more, preferably 15000 or less, and particularly preferably 12000 or less. On the other hand, weight-average molecular weight of (D2) component is 3000~20000, preferably 4000~6500, and more preferably 4500~5500.

As content of (D) ashless dispersant in the lubricating oil composition of the invention, to total mass of the composition (equivalent to nitrogen element), it must be preferably 0.01~0.4 mass %, preferably 0.02 mass % or more, more preferably 0.04 mass % or more, and preferably 0.3 mass % or less, more preferably 0.2 mass % or less, and further preferably 0.1 mass % or less. If the content of (D) ashless dispersant does not meet the above lower limit, anti-wear property under a condition of soot contamination becomes insufficient and sufficient detergent effect cannot be realized. Meanwhile, if the content goes over the above upper limit, property of low-temperature viscosity and demulsifying effect are possibly deteriorated; thereby it is not preferable.

When the (D1) component is used, in view of enhancing friction inhibiting property under a condition of soot contamination and showing excellent property of low-temperature viscosity, the content to total mass of the composition, equivalent to nitrogen element, is preferably 0.005~0.1 mass %, more preferably 0.01~0.04 mass %.

Also, when the (D2) component is used, so as to enhance the high-temperature detergency and thermal stability to the sufficient level, the content to total mass of the composition, equivalent to nitrogen element, is preferably 0.01 mass % or more, more preferably 0.02 mass % or more, and preferably 0.3 mass % or less, more preferably 0.1 mass % or less, furthermore preferably 0.04 mass % or less. In the same reasons, the content to total mass of the composition, equivalent to boron element, is preferably 0.001 mass % or more, more preferably 0.005 mass % or more, furthermore preferably 0.008 mass % or more, and preferably 0.2 mass % or less, more preferably 0.1 mass % or less, further preferably 0.04 mass % or less, and particularly preferably 0.02 mass % or less.

Moreover, as the (D2) component, a compound of which mass ratio of the boron content and nitrogen content (B/N ratio) is selected from normally in a range of 0.1~5, preferably 0.1~1, more preferably 0.2~0.6 is preferably used.

The mass ratio of the boron content and nitrogen content (B/N ratio) attributed to the (D) ashless dispersant of the invention lowers wear and friction under a condition of soot contamination; in order to enhance the high-temperature detergency, it is desirably contained in a range of preferably 0.01~5, more preferably 0.05~1, furthermore preferably 0.1~0.4, and particularly preferably 0.1~0.2.

<(E) Component>

The lubricating oil composition of the first embodiment of the present invention is capable to lower wear and friction under a condition of soot contamination and to show excellent high-temperature detergency with the above constitution. It can improve starting property and fuel saving performance at a time of cold shutdown. In order to further improve these properties, or depending on the other usages, optional additives conventionally used may be added to the lubricating oil. Especially, organomolybdenum compounds are suitably contained as an (E) component to the lubricating oil composition of the first embodiment of the invention.

Examples of organomolybdenum compounds include: (E1) organomolybdenum compounds (molybdenum friction modifier) selected from molybdenum dithiophosphate and molybdenum dithiocarbamate; and (E2) organomolybdenum compounds other than molybdenum dithiophosphate and molybdenum dithiocarbamate. Examples of (E2) component include: organomolybdenum compounds other than (E1) and containing sulfur as the constituent element; and organomolybdenum compounds (molybdenum antioxidant) without containing sulfur as the constituent element. For the first embodiment of the invention, it is particularly desirable to contain (E2) component.

As molybdenum dithiophosphate, for example, there may be compounds represented by the general formula (3) described in the above (A1) component.

As molybdenum dithiocarbamate, for instance, compounds represented by the general formula (4) described in the above (A1) component.

Examples of organomolybdenum compounds (E2) other than molybdenum dithiophosphate and molybdenum dithiocarbamate may be organomolybdenum compounds other than (E1) and containing sulfur as the constitutent element. Examples of the organomolybdenum compounds containing sulfur as the constitutent element include: complex and the like of molybdenum compounds (e.g., molybdenum oxide such as molybdenum dioxide and molybdenum trioxide; molybdic acid such as orthomolybdic acid, paramolybdic acid, and (poly)molybdenum sulfide; metal salt of these molybdic acid, and salt like ammonium salt of molybdic acid, molybdenum sulfide such as molybdenum disulfide, molybdenum trisulfide, molybdenum pentasulfide, and molybdenum polysulfide; molybdenum sulfide; metal salt or amine salt of molybdenum sulfide; and molybdenum halide like molybdenum chloride) and sulfur-containing organic compound (e.g., alkyl(thio)xanthate, thiadiazole, mercapto thiadiazole, thiocarbonate, tetrahydrocarbyl thiuramdisulfide, and bis(di(thio)hydrocarbyl dithiophosphonate) disulfide, organic (poly)sulfide, and sulfurized ester) and other organic compound; or complex of sulfur-containing molybdenum compound (such as the above molybdenum sulfide, sulfurized molybdic acid, or sulfide of molybdenum oxide) and sulfur-free (as the constituent element) organic compounds such as amine compound, succinimide, organic acid, alcohol, or the like which will be described in item below; sulfur-containing organomolybdenum compounds and the like obtained by reacting below-mentioned sulfur-free (as the constituent element) molybdenum compound, the sulfur-free organic compound, and sulfur source (e.g., element sulfur, hydrogensulfide, phosphorous pentasulfide, sulfur oxide, inorganic sulfide, hydrocarbyl(poly)sulfide, sulfurized olefin, sulfurized ester, sulfurized wax, sulfurized carboxylic acid, alkylphenol sulfide, thioacetamide, and thiourea). About these sulfur-containing organomolybdenum compounds, detailed manufacturing methods are described in e.g. Japanese Patent Application Laid-Open No. S56-10591 and U.S. Pat. No. 4,263,152.

As organomolybdenum compounds (E2) other than molybdenum dithiophosphate and molybdenum dithiocarbamate, sulfur-free (as the constituent element) organomolybdenum compounds may be used.

As the sulfur-free (as the constituent element) organomolybdenum compounds, specific examples include molybdenum-amine complex, molybdenum-succinimide complex, molybdenum salt of organic acid, and molybdenum salt of alcohol; among them, molybdenum-amine complex, molybdenum salt of organic acid, and molybdenum salt of alcohol are preferable.

Examples of molybdenum compound constituting the above molybdenum-amine complex include sulfur-free molybdenum compound such as molybdenum trioxide or hydrate thereof ($MoO_3.nH_2O$), molybdic acid ($H_2MoO_4$), alkali metal salt of molybdic acid ($M_2MoO_4$; "M" indicates alkali metal.), ammonium molybdate ($(NH_4)_2MoO_4$ or $(NH_4)_6$ $[Mo_7O_{24}].4H_2O$), $MoCl_5$, $MoOCl_4$, $MoO_2Cl_2$, $MoO_2Br_2$, and $Mo_2O_3Cl_6$. Among these molybdenum compounds, from the viewpoint of yield of molybdenum-amine complex, hexavalent molybdenum compounds are preferable. Further, in view of commercial availability, among the hexavalent molybdenum compound, molybdenum trioxide or hydrate thereof, molybdic acid, alkali metal salt of molybdic acid, and ammonium molybdate are preferable.

Moreover, amine compound constituting the molybdenum-amine complex is not particularly limited. Specific examples of nitrogen compound include: monoamine, diamine, polyamine, and alkanolamine. More specifically, there may be alkylamin having alkyl group (these alkyl groups may be straight-chain or branched.) of carbon number 1~30 such as methylamine, ethylamine, propylamine, butylamine, pentylamine, hexylamine, heptylamine, octylamine, nonylamine, decylamine, undecylamine, dodecylamine, tridecylamine, tetradecylamine, pentadecylamine, hexadecylamine, heptadecylamine, octadecylamine, dimethylamine, diethylamine, dipropylamine, dibutylamine, dipentylamine, dihexylamine, diheptylamine, dioctylamine, dinonylamine, didecylamine, diundecylamine, didodecylamine, ditridecylamine, ditetradecylamine, dipentadecylamine, dihexadecylamine, diheptadecylamine, dioctadecylamine, methylethylamine, methylpropylamine, methylbutylamine, ethylpropylamine, ethylbutylamine, and propylbutylamine; alkenyl amine having alkenyl group (these alkenyl groups may be straight-chain or branched.) of carbon number 2~30 such as ethenylamine, propenylamine, butenylamine, octenylamine, and oleyl amine; alkanolamine having alkanol group (these alkanol groups may be straight-chain or branched.) of carbon number 1~30 such as methanolamine, ethanolamine, propanolamine, butanolamine, pentanolamine, hexanolamine, heptanolamine, octanolamine, nonanolamine, methanolethanolamine, methanolpropanolamine, methanolbutanolamine, ethanolpropanolamine, ethanolbutanolamine, and propanolbutanolamine; alkylenediamine having alkylene group of carbon number 1~30 such as methylenediamine, ethylenediamine, propylenediamine, and butylenediamine; polyamine such as diethylene triamine, triethylene tetramine, tetraethylene pentamine, and pentaethylene hexamine; compound having alkyl group or alkenyl group of carbon number 8~20 in the above monoamine, diamine, polyamine such as undecyl diethylamine, undecyl diethanolamine, dodecyl dipropanolamine, oleyl diethanolamine, oleyl propylenediamine, stearyl tetraethylenepentamine, or heterocyclic compounds like imidazoline; alkylene oxide adduct of these compounds; and mixture of the above compounds. Among these amine compounds, primary amine, secondary amine, and alkanolamine are preferable.

Carbon number of hydrocarbon groups which exist in amine compound constituting the molybdenum-amine complex is preferably 4 or more, more preferably 4~30, and particularly preferably 8~18. If the carbon number of hydrocarbon groups in the amine compound is less than 4, the solubility tends to be deteriorated. Meanwhile, if the carbon number of the amine compound is set to 30 or less, it is capable to relatively enhance molybdenum content in the molybdenum-amine complex, and small dosage thereof make it possible to further enhance the effect of the present invention.

The molybdenum-succinimide complex may be a complex of sulfur-free molybdenum compound listed in the above description of molybdenum-amine complex, and succinimide having alkyl group or alkenyl group of carbon number 4 or more. Examples of succinimide include succinimide having at least one alkyl group or alkenyl group of carbon number 40~400 (described in the item of ashless dispersant below) in the molecule or the derivatives thereof, and succinimide having alkyl group or alkenyl group of carbon number 4~39, preferably carbon number 8~18. If carbon number of alkyl group or alkenyl group in the succinimide is less than 4, the solubility tends to be deteriorated. A succinimide having alkyl group or alkenyl group of carbon number over 30 and 400 or less is possibly used; however, by setting the carbon number of the alkyl group or alkenyl group to 30 or less, it is capable to relatively enhance molybdenum content in the molybdenum-succinimide complex and small dosage thereof make it possible to further enhance the effect of the present invention.

As the molybdenum salt of organic acid, salt of molybdenum oxide listed in the above description of the molybdenum-amine complex or molybdic base such as molybdenum hydroxide, molybdenum carbonate or molybdenum chloride with organic acid. As organic acid, it is preferably sulfur-free phosphorus-containing acid listed in the item of the above (B3) component, and carboxylic acid.

As carboxylic acid constituting molybdenum salt of carboxylic acid, it may be either monobasic acid or polybasic acid.

As a monobasic acid, fatty acid of which carbon number is normally 2~30, preferably 4~24 are used; the fatty acid may be straight-chain or branched, it may be saturated or unsaturated. The specific examples include: saturated fatty acid such as acetic acid, propionic acid, straight-chain or branched butanoic acid, straight-chain or branched pentanoic acid, straight-chain or branched hexanoic acid, straight-chain or branched heptanoic acid, straight-chain or branched octanoic acid, straight-chain or branched nonanoic acid, straight-chain or branched decanoic acid, straight-chain or branched undecanoic acid, straight-chain or branched dodecanoic acid, straight-chain or branched tridecanoic acid, straight-chain or branched tetradecanoic acid, straight-chain or branched pentadecanoic acid, straight-chain or branched hexadecanoic acid, straight-chain or branched heptadecanoic acid, straight-chain or branched octadecanoic acid, straight-chain or branched hydroxy octadecanoic acid, straight-chain or branched nonadecanoic acid, straight-chain or branched icosanoic acid, straight-chain or branched henicosanoic acid, straight-chain or branched docosanoic acid, straight-chain or branched tricosanoic acid, straight-chain or branched tetracosanoic acid; and unsaturated fatty acid such as acrylic acid, straight-chain or branched butenoic acid, straight-chain or branched pentenoic acid, straight-chain or branched hexenoic acid, straight-chain or branched heptenoic acid, straight-chain or branched octenoic acid, straight-chain or branched nonenoic acid, straight-chain or branched decenoic acid, straight-chain or branched undecenoic acid, straight-chain or branched dodecenoic acid, straight-chain or branched tridecenoic acid, straight-chain or branched tetradecenoic acid, straight-chain or branched pentadecenoic acid, straight-chain or branched hexadecenoic acid, straight-chain or branched heptadecenoic acid, straight-chain or branched octadecenoic acid, straight-chain or branched hydroxyocta decenoic acid, straight-chain or branched nonadecenoic acid, straight-chain or branched icosenoic acid, straight-chain or branched henicosenoic acid, straight-chain or branched docosenoic acid, straight-chain or branched tricosenoic acid, straight-chain or branched tetracosenoic acid; and mixture thereof.

Further, as the monobasic acid, other than the above fatty acids, monocyclic or polycyclic carboxylic acid (it may have hydroxyl groups.) may be used; the carbon number may be preferably 4~30, more preferably 7~30. Examples of monocyclic or polycyclic carboxylic acid include: aromatic carboxylic acid or cycloalkyl carboxylic acid, and etc. having zero to there, preferably one to two of straight-chain or branched alkyl group of carbon number 1~30, preferably carbon number 1~20. More specifically, there may be (alkyl) benzene carboxylic acid, (alkyl) naphthalene carboxylic acid, and (alkyl) cycloalkyl carboxylic acid. Preferable examples of monocyclic or polycyclic carboxylic acid include: benzoic acid, salicylic acid, alkyl benzoic acid, alkyl salicylic acid, and cyclohexane carboxylic acid.

As the polybasic acid, there may be dibasic acid, tribasic acid, and tetrabasic acid. The polybasic acid may be either linear polybasic acid or cyclic polybasic acid. In addition, in case of linear polybasic acid, it may be straight-chain or branched, and saturated or unsaturated. As linear polybasic acid, linear dibasic acid of carbon number 2~16 is preferable. The specific examples include: ethanedioic acid, propanedioic acid, straight-chain or branched butanedioic acid, straight-chain or branched pentanedioic acid, straight-chain or branched hexanedioic acid, straight-chain or branched heptanedioic acid, straight-chain or branched octanedioic acid, straight-chain or branched nonanedioic acid, straight-chain or branched decanedioic acid, straight-chain or branched undecanedioic acid, straight-chain or branched dodecanedioic acid, straight-chain or branched tridecanedioic acid, straight-chain or branched tetradecanedioic acid, straight-chain or branched heptadecanedioic acid, straight-chain or branched hexadecanedioic acid, straight-chain or branched hexenedioic acid, straight-chain or branched heptenedioic acid, straight-chain or branched octenedioic acid, straight-chain or branched nonenedioic acid, straight-chain or branched decenedioic acid, straight-chain or branched undecenedioic acid, straight-chain or branched dodecenedioic acid, straight-chain or branched tridecenedioic acid, straight-chain or branched tetradecenedioic acid, straight-chain or branched heptadecenedioic acid, straight-chain or branched hexadecenedioic acid, alkenyl succinic acid, and mixture thereof. Further, as cyclic polybasic acid, the examples may include: alicyclic dicarboxylic acid such as 1,2-cyclohexane dicarboxylic acid and 4-cyclohexene-1,2-dicarboxylic acid; aromatic dicarboxylic acid such as phthalic acid; aromatic tricarboxylic acid such as trimellitic acid; and aromatic tetracarboxylic acid such as pyromellitic acid.

As molybdenum salt of alcohol, there may be salt of sulfur-free molybdenum compound listed in the above description of molybdenum-amine complex and alcohol; the Alcohol may be any one of monovalent alcohol, polyvalent alcohol, partial ester or partial ether compounds of polyalcohol, and nitrogen compound (e.g. alkanolamine) having hydroxyl group. The molybdic acid is strong acid and it forms ester by reaction with alcohol; this ester to be formed by the molybdic acid and alcohol also contained in the molybdenum salt of alcohol of the invention.

As monovalent alcohol, normally a monovalent alcohol of carbon number 1~24, preferably 1~12, and more preferably 1~8 are preferably used. Such an alcohol may be straight-chain or branched one, and saturated or unsaturated one. Examples of alcohol of carbon number 1~24, specifically, include: methanol, ethanol, straight-chain or branched propanol, straight-chain or branched butanol, straight-chain or branched pentanol, straight-chain or branched hexanol, straight-chain or branched heptanol, straight-chain or branched octanol, straight-chain or branched nonanol, straight-chain or branched decanol, straight-chain or branched undecanol, straight-chain or branched dodecanol, straight-chain or branched tridecanol, straight-chain or branched tetradecanol, straight-chain or branched pentadecanol, straight-chain or branched hexadecanol, straight-chain or branched heptadecanol, straight-chain or branched octadecanol, straight-chain or branched nonadecanol, straight-chain or branched icosanol, straight-chain or branched henicosanol, straight-chain or branched tricosanol, straight-chain or branched tetracosanol; and mixture thereof.

As polyvalent alcohol, normally, divalent to decavalent, preferably divalent to hexavalent alcohol may be used. Examples of divalent to decavalent polyvalent alcohol include: specifically, divalent alcohol such as ethyleneglycol, diethyleneglycol, polyethyleneglycol (trimer to pentadecamer of ethyleneglycol), propyleneglycol, dipropyleneglycol, polypropyleneglycol (trimer to pentadecamer of propyleneglycol), 1,3-propanediol, 1,2-propanediol, 1,3-butanediol, 1,4-butanediol, 2-methyl-1,2-propanediol, 2-methyl-1,3-propanediol, 1,2-pentanediol, 1,3-pentanediol, 1,4-pentanediol, 1,5-pentanediol, and neopentylglycol; polyvalent alcohol such as glycerin, polyglycerin (dimer to octomer of glycerin, e.g. diglycerin, triglycerin, tetraglycerin), trimethylol alkane (e.g. trimethylol ethane, trimethylolpropane, trimethylol butane) and dimer to octomer thereof, pentaerythritol and dimer to tetramer thereof, 1,2,4-butanetriol, 1,3,5-pentanetriol, 1,2,6-hexanetriol, 1,2,3,4-butanetetrol, sorbitol, sorbitan, sorbitol glycerin condensation, adonitol, arabitol, xylitol, and mannitol; sugar group such as xylose, arabinose, ribose, rhamnose, glucose, fructose, galactose, mannose, sorbose, cellobiose, maltose, isomaltose, trehalose, and sucrose; and mixture thereof.

Furthermore, as partial ester of polyvalent alcohol, there may be compounds of which part of hydroxyl group of the polyvalent alcohol listed in the description of polyvalent alcohol is esterified by hydrocarbyl; among them, glycerin monoolate, glycerin diolate, sorbitan monoolate, sorbitan diolate, pentaerythritol monoolate, polyethyleneglycol monoolate, and polyglycerin monoolate are preferable.

As partial ether of polyvalent alcohol, there may be compounds of which part of hydroxyl group of the polyvalent alcohol listed in the description of polyvalent alcohol is etherified by hydrocarbyl, or compounds (sorbitan condensation, etc.) in which ether bonds are formed by condensation of inter-polyvalent alcohol. Among them, 3-octadecyloxy-1,2-propanediol, 3-octadecenyloxy-1,2-propanediol, and polyethyleneglycol alkylether are preferable.

Examples of nitrogen compound having hydroxyl group include alkanolamine listed in the above description of the molybdenum-amine complex, and alkanolamide (diethanolamide, etc.) in which amino group of the alkanol is amidated. Among them, stearyl diethanolamine, polyethyleneglycol stearylamine, polyethyleneglycol dioleylamine, hydroxyethyl laurylamine, oleic diethanolamide, and so on are preferable.

As (E) organomolybdenum compounds of the present invention, in view of excellent initial friction reducing effect, one or a combination of two or more of sulfur-containing organomolybdenum compounds (E1) selected from molybdenum dithiophosphate and molybdenum dithiocarbamate are preferably used. Further, in view of excellent high-temperature detergency, capability to inhibit increase of viscosity and to prolong the fuel saving performance, organomolybdenum compound (E2) other than molybdenum dithiophosphate and molybdenum dithiocarbamate should be preferably used. As (E2) component, among the compounds listed above: complex or salt of sulfur-containing molybdenum compound (e.g. molybdenum sulfide, molybdenum oxysulfide, and sulfide of molybdic acid) and sulfur-free (as the constitutent element) organic compound (e.g. amine compound, succinimide, alcohol, carboxylic acid); complex or salt of sulfur-free (as the constitutent element) molybdenum compound (e.g. oxymolybdenum, molybdic acid) and, sulfur-free (as the constitutent element) organic compound (e.g. amine compound, succinimide, alcohol, carboxylic acid); and one or a combination of two or more of organomolybdenum compounds selected from organomolybdenum compound obtained by reacting sulfur-containing molybdenum compound or sulfur-free (as the constitutent element) molybdenum compound, sulfur-free (as the constitutent element) organic compound, and sulfur source.

In the invention, from the viewpoint of excellent high-temperature detergency and capability to obtain a composition having excellent durability of initial fuel saving performance under a condition of soot contamination, using (E2) is particularly preferable.

In the composition of the first embodiment of the invention, when organomolybdenum compound is used, the dosage thereof is not particularly limited. To total mass of the composition, equivalent to molybdenum element, it is preferably 0.001 mass % or more, preferably 0.005 mass % or more, more preferably 0.01 mass % or more. It is also preferably 0.2 mass % or less, preferably 0.1 mass % or less, more preferably 0.05 mass % or less, and particularly preferably 0.03 mass % or less. If the content is less than 0.001 mass %, thermal-oxidation stability of the lubricating oil composition becomes insufficient, that especially cause a tendency of inability to maintain the excellent detergency for a long term. On the other hand, if content becomes over 0.2 mass %, effect in proportion to the dosage cannot be obtained, and storage stability of the lubricating oil composition tends to decline.

<Additives>

In order to further improve performance of the lubricating oil composition of the present invention, or for the other usage, optional additives which are conventionally used may be added to the lubricating oil. As the additives of the lubricating oil composition of the second embodiment of the invention may be ashless friction modifier, and metallic detergent other than (C') component. Moreover, as common additives between lubricating oil compositions of the first and the second embodiments, the examples include ashless antioxidant, organometallic antioxidant, viscosity index improver, anti-wear agent other than (B) component, corrosion inhibitor, rust inhibitor, demulsifier, metal deactivator, defoamant, and coloring agent.

As ashless friction modifier, it may be ashless friction modifier of the above (A) component.

As metallic detergent other than (C') component, there may be commonly known naphthenate detergent, and phosphonate detergent. Dosage of these detergents to total mass of the composition is usually selected from the range of 0.005~0.5 mass % as metal content.

As ashless antioxidant, for example, ashless antioxidant and the like, such as phenolic antioxidant and aminic antioxidant, any kind of conventionally used antioxidant for lubricating oil is available. By adding the above antioxidant, it is capable to enhance antioxidant characteristic of the lubricating oil composition; it may further enhance the oxidation stability, high-temperature detergency, and property of base-number retention of the composition of the present invention.

Examples of phenolic antioxidant preferably include: 4,4'-methylenebis(2,6-di-tert-butylphenol), 4,4'-bis (2,6-di-tert-butylphenol), 4,4'-bis (2-methyl-6-tert-butylphenol), 2,2'-methylenebis (4-ethyl-6-tert-butylphenol), 2,2'-methylenebis (4-methyl-6-tert-butylphenol), 4,4'-butylidenebis (3-methyl-6-tert-butylphenol), 4,4'-isopropylidenebis (2,6-di-tert-butylphenol), 2,2'-methylenebis (4-methyl-6-nonylphenol), 2,2'-isobutylidenebis (4,6-dimethylphenol), 2,2'-methylenebis (4-methyl-6-cyclohexylphenol), 2,6-di-tert-butyl-4-methylphenol, 2,6-di-tert-butyl-4-ethylphenol, 2,4-dimethyl-6-tert-butylphenol, 2,6-di-tert-α-dimethylamino-p-cresol, 2,6-di-tert-butyl-4 (N,N'-dimethyl aminomethylphenol), 4,4'-thiobis (2-methyl-6-tert-butylphenol), 4,4'-thiobis (3-methyl-6-tert-butylphenol), 2,2'-thiobis (4-methyl-6-tert-butylphenol), bis(3-methyl-4-hydroxy-5-tert-butylbenzyl) sulfide, bis(3,5-di-tert-butyl-4-hydroxybenzyl)sulfide, 2,2'-thio-diethylenebis[3-(3,5-di-tert-butyl-4-hydroxyphenyl) propionate], tridecyl-3-(3,5-di-tert-butyl-4-hydroxyphenyl) propionate, pentaerythrityl-tetrakis[3-(3,5-di-tert-butyl-4-hydroxyphenyl)propionate], octyl-3-(3,5-di-tert-butyl-4-hydroxyphenyl)propionate, octadecyl-3-(3,5-di-tert-butyl-4-hydroxyphenyl)propionate, 3-methyl-5-tert-butyl-4-hydroxyphenyl substituted fatty acid esters. The examples also include a mixture of two or more of the above.

As aminic antioxidant, for example, it may be phenyl-α-naphthylamine, alkylphenyl-α-naphthylamine, and dialkyldiphenylamine. It may be a mixture of two or more thereof.

Moreover, as organometallic antioxidant, commonly known organometallic antioxidant which contains metal and in which antioxidant effect is observed may be used. Among the above-mentioned organomolybdenum compound, (E2) component may be used.

The above phenolic antioxidant, aminic antioxidant, and organometallic antioxidant may be blended as a combination thereof.

When antioxidant is contained in the lubricating oil composition of the invention, to total mass of the lubricating oil composition, the dosage is usually 0.01~20 mass %, preferably 0.1~10 mass %, more preferably 0.5~5 mass %. When the dosage goes over 20 mass %, sufficient performance in proportion to the dosage cannot be obtained; meanwhile, when the dosage is less than 0.01, as improving effect of the property of base-number retention is small. Thus, both of them are not preferable.

As the viscosity index improver, there may be nondispersive or dispersant-type viscosity index improver. Specific examples thereof include: nondispersant or dispersant polymethacrylates, nondispersant or dispersant ethylene-α-olefin copolymer or hydrogenated product thereof, polyisobutylene or hydrogenated product thereof, styrene-dien hydrogenated copolymer, styrene-maleic anhydride ester copolymer, polymethacrylate-styrene copolymer, polymethacrylate-olefin copolymer, and polyalkylstyrene. Dosage of the viscosity index improver to be contained to total mass of the composition, is normally 0.1~20 mass %, preferably 1~15 mass %, further preferably 3~10 mass %.

As anti-wear agent other than (B) component, for example, sulfur extreme pressure agent may be used. It is expected to show anti-wear effect under a condition of soot contamination.

Examples of sulfur extreme pressure agent include: sulfur-containing compounds such as disulfides, polysulfides, sulfurized olefins, sulfurized fats, sulfurized ester, dithiocarbamate, and zinc dithiocarbamate; and sulfurized fat is most preferable. Among these compounds, compounds of which sulfur content in the sulfur extreme pressure agent is preferably 1~40 mass %, more preferably 5~20 mass %, further preferably 5~15 mass % are desirably used. If sulfur content in the sulfur extreme pressure agent is too high, the anti-wear effect under a condition of soot contamination in proportion to the sulfur content cannot be obtained, it rather deteriorates the property of base-number retention. On the other hand, if sulfur content in the sulfur extreme pressure agent is small, anti-wear effect under a condition of soot contamination is small. As other anti-wear agents, commonly known agents such as borate ester, ashless anti-wear agent, metallic anti-wear agent, and so on can be used.

In the lubricating oil composition of the invention, dosage of anti-wear agent other than (B) component to be contained to total mass of the composition is usually 0.01~10 mass %, preferably 0.1~5 mass %.

As corrosion inhibitor, there may be benzotriazole, tolyl triazole, thiadiazole, and imidazole compound.

Examples of rust inhibitor include: petroleum sulfonate, alkylbenzene sulfonate, dinonylnaphthalene sulfonate, alkenyl succinate, and polyvalent alcohol ester.

Examples of demulsifier include polyalkylene glycolic nonionic surfactant and the like such as polyoxyethylene alkylether, polyoxyethylene alkylphenylether, and polyoxyethylene alkylnaphthyl ether.

Examples of metal deactivator include: imidazoline, pyrimidine derivatives, alkylthiadiazole, mercapto benzothiazole, benzotriazole or derivatives thereof, 1,3,4-thiadiazole polysulfide, 1,3,4-thiadiazolyl-2,5-bisdialkyl dithiocarbamate, 2-(alkyldithio) benzimidazole, and β-(o-carboxybenzylthio)propionitrile.

As pour-point depressant, any kind of commonly known pour-point depressant may be selected depending on the properties of lubricant base oil; polymethacrylate of which weight-average molecular weight is over 50000 and 150000 or less, preferably 80000~120000 is preferable.

As the defoamant, any kind of compounds usually used as defoamant for lubricating oil are available; for instance, silicones such as dimethyl silicone and fluoro silicone. A certain amount of one or a combination of two or more compounds optionally selected from the above may be blended. As defoamant, examples thereof include: silicone oil, alkenyl succinate derivatives, ester of polyhydroxy aliphatic alcohol and long-chain fatty acid, aromatic amine salt of methylsalicylate with o-hydroxybenzyl alcohol, aluminum stearate, potassium oleate, N-dialkyl-allylamine nitroaminoalkanol, or isoamyloctyl phosphate, alkylalkylenedi phosphate, metal derivatives of thioether, metal derivatives of disulfide, fluorine compound of aliphatic hydrocarbon, triethyl silane, dichlorosilane, alkylphenyl polyethyleneglycol ethersulfide, and fluoroalkylether.

As coloring agent, any kind of usually used compounds may be available, and a certain dosage of these may be blended. The dosage to total mass of the composition is normally 0.001~1.0 mass %.

When adding these additives to the lubricating oil composition of the invention, the dosage of corrosion inhibitor, rust inhibitor, and demulsifier to total mass of the composition is respectively 0.005~5 mass %. And the dosage of metal deactivator is 0.005~1 mass %, dosage of pour-point depressant is 0.01~1 mass %, dosage of defoamant is 0.0001~1 mass %, dosage of coloring agent is 0.001~1.0 mass %.

Sulfur content in the lubricating oil composition of the invention is not particularly limited; 0.3 mass % or less is preferable, 0.26 mass % or less is more preferable, 0.2 mass % or less is furthermore preferable, and 0.15 mass % or less is particularly preferable. If sulfur content becomes more than 0.3 mass %, life of oxidation catalyst of exhaust-gas after-treatment device, $NO_X$ storage reduction catalyst, and DPF tends to be shortened. Also, as for sulfated ash-content of the lubricating oil composition of the invention, in view of maintaining performance of the exhaust-gas after-treatment device, by setting the dosage within the range: preferably 1.2 mass % or less, more preferably 1.0 mass % or less, further preferably 0.9 mass % or less, and preferably 0.3 mass % or more, particularly 0.7 mass % or more, it is possible to obtain the composition which is capable to reduce wear and friction under a condition of soot contamination and to show excellent high-temperature detergency.

Kinematic viscosity at 100° C. of the lubricating oil composition of the invention, from the viewpoint of possibility to suitably maintain the lubricity of the engine, is usually 5~30 $mm^2/s$; in view of capability to maintain the anti-wear property under a condition of soot contamination and to inhibit friction resistance caused by stirring resistance, it is preferably 8~25 $mm^2/s$, more preferably 9.3~16.3 $mm^2/s$, particularly preferably 9.3~11.5 $mm^2/s$.

Moreover, viscosity index of the lubricating oil composition of the invention, in view of improvement of viscosity-temperature characteristic and fuel saving performance, is normally 140 or more, preferably 150 or more, more preferably 160 or more, furthermore preferably 170 or more; in view of excellent shear stability, high-temperature detergency, and property of base-number retention, it is preferably 250 or less, more preferably 200 or less, furthermore preferably 190 or less.

Further, the lubricating oil composition of the present invention can reduce wear particularly under a condition of soot contamination by setting TBS viscosity at 150° C. thereof within the range of preferably 2.6 mPa·s or more, particularly 2.9~3.7 mPa·s, and the lubricating oil composition can also have excellent property of low-temperature starting in winter time and in cold region as well as improve fuel saving performance under cold shutdown by setting CCS viscosity at −25° C. thereof within the range of 3500 mPa·s or less or CCS viscosity at −30° C. thereof within the range of 3250 mPa·s or less. By setting the viscosity within the above range, a lubricating oil composition suitable for engine oil of grade: 0W-20, 5W-20, 0W-30, and 5W-30, specifically 0W-30 engine oil can be obtained.

The lubricating oil composition of the first embodiment of the invention is capable to reduce wear and friction and is excellent in high-temperature detergency, which especially inhibit increase of wear and friction by soot mixing, which becomes unignorable when dosage of phosphorous compound such as ZnDTP is reduced, is able to maintain the above property for a long term and to ease impact on exhaust-gas after-treatment device.

The lubricating oil composition of the second embodiment of the invention is capable to inhibit increase of wear by soot mixing that becomes unignorable when dosage of phosphorous compound such as ZnDTP is reduced and to ease impact on exhaust-gas after-treatment device.

Accordingly, the lubricating oil composition of the first and second embodiments is a lubricating oil composition suitably used for diesel engine equipped with exhaust-gas after-treatment device such as DPF and various catalyst and for direct-injection gasoline engine. It is not only for the engine of the above usage, but also suitably used for gasoline engine, diesel engine, and gas engine for e.g. two-wheel vehicle, four-wheel vehicle, electric power generation, and cogeneration. Moreover, it is not only suitably used for these various engine using fuel of which sulfur content is 50 mass ppm or less, but also useful for various engine for marine vessel and outboard motor. Further, it is suitably used for lubricating oil for internal combustion engine using low-sulfur fuel, for example, fuel of sulfur content is 50 mass ppm or less, more preferably 30 mass ppm or less, particularly preferably 10 mass ppm or less (e.g. gasoline, gas oil, kerosene, alcohol, dimethylether, LPG, natural gas, hydrogen, and GTL (gas to liquid) fuel). Moreover, the lubricating oil composition of the first and second embodiments is excellent in oxidation stability may be suitably used for lubricating oil such as lubricating oil for drive-train module like automatic or manual transmission, grease, wet-type brake oil, hydraulic oil, turbine oil, compressor oil, bearing oil, and refrigerant oil.

EXAMPLES

Hereinafter, the present invention will be more specifically described by way of the following examples. However, the invention is not particularly limited by these examples.

The Lubricating Oil Composition of the First Embodiment of the Invention

So as to have composition shown in Table 1, seven types of lubricating oil compositions, i.e. Examples 1~5 and Comparative examples 1~2, were prepared. As the base oil, three types of base oils, i.e. base oils O-1~O-3 were used. Here, base oil O-1 (X2) equivalent to base oil (X) was oligomer hydrogenated product (poly-α-olefin hydrogenated product) of α-olefin of carbon number 8~12; base oil O-2 equivalent to base oil (Ya) and another base oil O-3 were hydrocracked mineral oil. Ratio of the base oil was determined based on the total mass of base oil, and additive dosage of the various additives was determined based on the total mass of the composition. Performance of these lubricating oil compositions were evaluated by the following tests. Together with that, the evaluation results are also shown in Table 1.

(1) High-Speed Four-Ball Test

So as to prepare soot-mixed oil on trial, firstly 1.5 mass % of carbon black was dispersed into a test oil, and High-speed Four-ball Test was carried out under the test condition in accordance with JPI-5S-32-90, then diameter of wear scar was measured. In the test, if diameter of wear scar was smaller, that means the lubricating oil composition used was excellent in anti-wear performance.

(Test Condition)

Number of revolutions: 1500 rpm

Load: 294N

Temperature of test oil: 110° C.

Test time: one hour (2) HFRR Friction Test

A new oil and an oil where 1.5 mass % of carbon black was dispersed in the new oil were used. The friction coefficient was measured under the following condition by using HFRR friction tester. The obtained results are shown in Table 1. In the test, if friction coefficient is smaller, that means the lubricating oil composition used is excellent in fuel saving performance; and if friction coefficient after addition of carbon black is smaller, that means the lubricating oil composition used is excellent in maintaining friction reducing effect.

(Test Condition)

Load: 200 g

Temperature of test oil: 100° C.

Stroke: 1 mm

Frequency: 50 Hz

Test duration: one hour

Friction coefficient measurement: friction coefficient measured until 50~60 minutes later was averaged.

(3) Detergency Test

In accordance with JPI-5S-55-99, Hot Tube Test was carried out. The rating is determined by giving ten points for clear and colorless (no lacquer) and zero point for opaque in black color. Then, the lubricating oil compositions were evaluated with reference to standard tubes prepared in advance showing transparency and color of point-by-point rating between the above ten to zero.

TABLE 1

| | | Example 1 | Example 2 | Example 3 | Example 4 | Example 5 | Comparative example 1 | Comparative example 2 |
|---|---|---|---|---|---|---|---|---|
| Base oil (to total mass of Base oil) | | | | | | | | |
| Base oil O-1 | mass % | 65 | 65 | 65 | 65 | 65 | | 65 |
| Base oil O-2 | mass % | 35 | 35 | 35 | 35 | 35 | 35 | 35 |
| Base oil O-3 | mass % | | | | | | 65 | |

TABLE 1-continued

| | | Example 1 | Example 2 | Example 3 | Example 4 | Example 5 | Comparative example 1 | Comparative example 2 |
|---|---|---|---|---|---|---|---|---|
| Additives (to total mass of the composition) | | | | | | | | |
| Ashless friction modifier A-1 | mass % | 0.3 | 0.3 | 0.3 | 0.3 | | 0.3 | 0.3 |
| Ashless friction modifier A-2 | mass % | | | | | 0.3 | | |
| Phosphorous-containing anti-wear agent B3-1 | P-content, mass % | 0.05 | 0.05 | | | 0.05 | 0.05 | |
| Phosphorous-containing anti-wear agent B3-2 | P-content, mass % | | | 0.05 | | | | |
| Phosphorous-containing anti-wear agent B1 | P-content, mass % | | | | 0.05 | | | |
| Metallic detergent C-1 | metal-content, | | 0.024 | 0.024 | 0.024 | 0.024 | | 0.024 |
| Metallic detergent C-2 | metal-content, | 0.21 | 0.21 | 0.21 | 0.21 | 0.21 | 0.21 | 0.21 |
| Metallic detergent C-3 | metal-content, | 0.03 | | | | | 0.03 | |
| Dispersant D1 | N-content, mass % | 0.03 | 0.03 | 0.03 | 0.03 | 0.03 | 0.03 | 0.03 |
| Dispersant D2 | N-content, mass % | 0.03 | 0.03 | 0.03 | 0.03 | 0.03 | 0.03 | 0.03 |
| Organo-Mo compound E1 | Mo-content, mass % | | | | | | | 0.05 |
| Organo-Mo compound E2 | Mo-content, mass % | 0.02 | 0.02 | 0.02 | 0.02 | 0.02 | 0.02 | |
| Ashless antioxidant F | mass % | 0.8 | 0.8 | 0.8 | 0.8 | 0.8 | 0.8 | 0.8 |
| Other additives G | mass % | 8 | 8 | 8 | 8 | 8 | 8 | 8 |
| Evaluation results | | | | | | | | |
| Wear by High-speed Four-ball Test | 1.5% CB, mm | 0.50 | 0.48 | 0.40 | 0.47 | 0.48 | 0.55 | 0.63 |
| HFRR friction coefficient | New oil | 0.067 | 0.065 | 0.067 | 0.069 | 0.064 | 0.067 | — |
| | CB 1.5% | 0.068 | 0.070 | 0.070 | 0.072 | 0.068 | 0.090 | — |
| Hot Tube Test rating | | 10 | 10 | 10 | 8 | 10 | 9.5 | — |

O-1: Kinematic viscosity at 100° C.: 3.9 $mm^2/s$, Viscosity index: 126, % $C_P$: 91, % $C_A$: 0, % $C_N$: 9, S: below 0.01 mass %, CCS viscosity at −35° C.: 1500 mPa · s, Iodine number: 0.5, NOACK: 12 mass %

O-2: Kinematic viscosity at 100° C.: 6.6 $mm^2/s$, Viscosity index: 129, % $C_P$: 78, % $C_A$: 0, % $C_N$: 22, S: below 0.01 mass %, CCS viscosity at −35° C.: 13000 mPa · s, Iodine number: 5, NOACK: 7 mass %

O-3: Kinematic viscosity at 100° C.: 4.1 $mm^2/s$, Viscosity index: 123, % $C_P$: 78, % $C_A$: 0, % $C_N$: 22, S: below 0.01 mass %, CCS viscosity at −35° C.: 3300 mPa · s, Iodine number: 1, NOACK: 16 mass %

A-a: oleyl urea

A-b: oleic hydrazide

B3-1: zinc dibutylphosphoric acid (P: 13.2 mass %, S: 0 mass %, ZN: 13 mass %)

B3-2: zinc 2-ethylhexylphosphoric acid

B1: secC4/secC6-ZnDTP (Zn: 7.2 mass %, P: 6.2 mass %, S: 14.9 mass %)

C-1: calcium sulfonate (Ca: 2.4 mass %, S: 2.9 mass %, Metal ratio: 1.0)

C-2: over-based calcium sulfonate (Ca: 12.7 mass %, S: 2.0 mass %, Metal ratio: 12)

C-3: calcium salicylate (Ca: 2.1 mass %, Metal ratio: 1.0)

D1: bis-type polybutenyl succinimide (N: 0.6 mass %, Mw: 10000)

D2: borate modification of bis-type polybutenyl succinimide (N: 1.5 mass %, B: 0.5 mass %, Mw: 5000)

E1: molybdenum dithiocarbamate (Mo: 10 mass %, S: 10 mass %)

E2: oxymolybdenum-ditridecyl amine complex

F: alkyl diphenylamine

G: Viscosity index improver, pour-point depressant, anti-forming agent, etc.

As shown in Table 1, the lubricating oil composition of Examples 1~5 are excellent in anti-wear property even when carbon black is dispersed, the friction coefficient at a time when it is new oil (before contamination) and even when carbon black is dispersed are respectively small, and moreover, these lubricating oil compositions are excellent in high-temperature detergency. Especially, the lubricating oil composition of Example 3 using zinc 2-ethylhexylphosphate (mono-di mixture) instead of using zinc dibutylphosphate of Example 1 is found out that it can significantly reduce the amount of wear. As seen from these results, the lubricating oil compositions of Examples 1~5 are excellent in anti-wear property and fuel saving performance even under a condition of soot contamination, and these lubricating oil compositions are also capable to maintain sufficient fuel saving performance for a long term. Further, since the lubricating oil composition of Example 1 has only 0.76 mass % of sulfated ash content and the lubricating oil composition of Example 2 has only 0.83 mass % of the same, those mean these compositions are low-ash type. Accordingly, these compositions are capable to sufficiently maintain the performance of the exhaust-gas after-treatment device for a long term.

The lubricating oil compositions of Examples 1~5 meet the standard of viscosity grade of SAE 0W and 5W, these also meet the standard of viscosity grade of SAE 30. So, as clearly seen from results of these Examples, even under normal conditions of use, the lubricating oil compositions is excellent in high-temperature detergency, anti-wear property, and fuel saving performance, particularly excellent in anti-wear property and fuel saving performance under a condition of soot contamination. It is further excellent in property of low-temperature starting and fuel saving performance at a time of cold shutdown in winter time or cold region.

On the other hand, compared with the lubricating oil composition of Examples 15, lubricating oil composition of the Comparative examples, showed the results such that wear volume when carbon black was dispersed is large and value of friction coefficient is high. In case of the lubricating oil composition of Comparative example 1 which does not contain base oil (X) of Example 1, wear volume when carbon black is dispersed is large and the value of friction coefficient is also high. In case of lubricating oil composition of Comparative example 2 to which phosphorous anti-wear agent is not added, substantial deterioration of anti-wear property was observed.

The Lubricating Oil Composition of the Second Embodiment

So as to have composition shown in Table 2, four types of lubricating oil compositions, i.e. Example 6 and Comparative examples 3~5, were prepared. Here, base oil O-1 (X2) equivalent to base oil (X) is oligomer hydrogenated product (poly-α-olefin hydrogenated product) of α-olefin of carbon number 8~12; base oil O-2 equivalent to base oil (Ya) is hydrocracked mineral oil. Ratio of the base oil is determined based on the total mass of base oil, and additive dosage of the various additives is based on the total mass of the composition. Performance of these lubricating oil compositions were evaluated by the High-speed Four-ball Test. The evaluation methods are the same as those of the first embodiment of the invention. Together with that, the evaluation results are also shown in Table 2.

As shown in Table 2, the lubricating oil composition of Example 6 made by preparing the metal ratio of metallic detergent to 5.6 is excellent in anti-wear property when carbon black is dispersed. Moreover, in the lubricating oil composition of Example 6, compared with a case where sulfonate detergent of which metal ratio is 12 is used by itself, friction coefficient and high-temperature detergency were improved. Also, compared with a case where sulfonate detergent of which metal ratio is 1 is used by itself, improvement of its anti-wear property under a condition of soot contamination was observed. The lubricating oil composition of Example 6 has only 1.0 mass % of sulfated ash content, that means the composition is low-ash type. Accordingly, it is capable to sufficiently maintain the performance of the exhaust-gas after-treatment device for a long term. In addition, the lubricating oil composition of Example 6 meets the standard of viscosity grade of SAE 0W and 5W, it also meets the standard of viscosity grade of SAE 30. Therefore, as clearly seen from results of the Example, even under normal conditions of use, the lubricating oil compositions is excellent in fuel saving performance, and friction inhibiting property under a condition of soot contamination. It is further excellent in property of low-temperature starting and fuel saving performance at a time of cold shutdown in winter time or cold region.

TABLE 2

Table 2

| | | Example 6 | Comparative example 3 | Comparative example 4 | Comparative example 5 |
|---|---|---|---|---|---|
| Base oil (to total mass of Base oil) | | | | | |
| Base oil O-1 | mass % | 65 | 65 | 65 | 65 |
| Base oil O-2 | mass % | 35 | 35 | 35 | 35 |
| Additives (to total mass of the composition) | | | | | |
| Organo-Mo compound A1 | Mo-content, mass % | 0.05 | 0.05 | | 0.05 |
| Phosphorous-containing anti-wear agent B3 | P-content, mass % | 0.05 | 0.05 | 0.05 | |
| Metallic detergent C1a | metal-content, mass % | 0.024 | | | |
| Metallic detergent C1b | metal-content, mass % | 0.21 | 0.15 | 0.21 | 0.21 |
| Metallic detergent C3 | metal-content, mass % | | 0.07 | 0.03 | 0.03 |
| Metal ratio of Metallic detergent | | 5.6 | 2.6 | 4.9 | 4.9 |
| Dispersant D1 | N-content, mass % | 0.03 | 0.03 | 0.03 | 0.03 |
| Dispersant D2 | N-content, mass % | 0.03 | 0.03 | 0.03 | 0.03 |
| Ashless antioxidant F | mass % | 0.8 | 0.8 | 0.8 | 0.8 |
| Other additives G | mass % | 8 | 8 | 8 | 8 |
| Evaluation results | | | | | |
| Wear by High-speed Four-ball Test | 1.5% CB, mm | 0.45 | 0.57 | 0.58 | 0.67 |

O-1: Kinematic viscosity at 100° C.: 3.9 $mm^2/s$, Viscosity index: 126, % $C_P$: 91, % $C_A$: 0, % $C_N$: 9, S: below 0.01 mass %, CCS viscosity at −35° C.: 1500 mPa · s, Iodine number: 0.5, NOACK: 12 mass %
O-2: Kinematic viscosity at 100° C.: 6.6 $mm^2/s$, Viscosity index: 129, % $C_P$: 78, % $C_A$: 0, % $C_N$: 22, S: below 0.01 mass %, CCS viscosity at −35° C.: 13000 mPa · s, Iodine number: 5, NOACK: 7 mass %
A1: molybdenum dithiocarbamate (Mo: 10 mass %, S: 10 mass %)
B3: zinc dibutylphosphoric acid (P: 13.2 mass %, S: 0 mass %, ZN: 13 mass %)
C1a: calcium sulfonate (Ca: 2.4 mass %, S: 2.9 mass %, Metal ratio: 1.0)
C1b: over-based calcium sulfonate (Ca: 12.7 mass %, S: 2.0 mass %, Metal ratio: 12)
C3: calcium salicylate (Ca: 2.1 mass %, Metal ratio: 1.0)
D1: bis-type polybutenyl succinimide (N: 0.6 mass %, Mw: 10000)
D2: borate modification of bis-type polybutenyl succinimide (N: 1.5 mass %, B: 0.5 mass %, Mw: 5000)
F: alkyl diphenylamine
G: Viscosity index improver, pour-point depressant, anti-forming agent, etc.

On the other hand, Comparative example 3 of which metal ratio of metallic detergent is set to less than 3.0, and lubricating oil composition of Comparative examples 4~5, those of which do not contain organomolybdenum compound and phosphorus-containing anti-wear agent, do not have sufficient anti-wear property when carbon black is dispersed. Specifically, when a certain amount of salicylate detergent of which metal ratio is small is contained, presumably anti-wear effect is not sufficiently realized due to the interaction of various additives such as soot (carbon black), molybdenum dithiocarbamate, and zinc alkylphosphoric acid. In other words, in the present invention, since metallic detergent is optimized by combining one of which metal ratio is less than 2 and another one of which metal ratio is 6 or more, it is capable to obtain the lubricating oil composition which is excellent in balance among anti-wear property at a time of soot contamination, high-temperature detergency, and low-friction.

The above has described the present invention associated with the most practical and preferred embodiments thereof. However, the invention is not limited to the embodiments disclosed in the specification. Thus, the invention can be appropriately varied as long as the variation is not contrary to the subject substance and conception of the invention which can be read out from the claims and the whole contents of the specification. It should be understood that lubricating oil composition with such an alternation are included in the technical scope of the invention.

What is claimed is:

1. A lubricating oil composition comprising a lubricant base oil containing a base oil (X) of which % $C_P$ is 70~97, % $C_A$ is 1 or less, % $C_N$ is 3~30, % $C_P$/% $C_N$ is 4 or more, viscosity index is 115 or more, NOACK evaporation is 8~16 mass %, and CCS viscosity at −35° C. is 3000 mPa·s or less, wherein said lubricant base oil, to total mass of the composition, contains following components (A)~(D):

(A) 0.01~10 mass % of ashless friction modifier;

(B) 0.01~0.2 mass % of phosphorus-containing anti-wear agent as phosphorous content;

(C) 0.01~1 mass % of metallic detergent as metal content; and (D) 0.01~0.4 mass % of ashless dispersant having 3000~20000 of weight-average molecular weight as nitrogen content, wherein said (A) component is one or more compound selected from the group consisting of: aliphatic polyamine, imide compound, an ester of fatty acid with aliphatic polyvalent alcohol, fatty acid amide, fatty acid, aliphatic alcohol, aliphatic ether, respectively having at least one of hydrocarbon group of carbon number 6~30 within the molecule, compounds containing nitrogen represented by the following general formulas (1) and (2), and acid modification derivatives thereof, and wherein said (B) component is one compound selected from the group consisting of: a phosphorus compound represented by the following general formula (5), a phosphorus compound represented by the following general formula (6), metal salts thereof, amine salts thereof, and derivatives thereof;

(1)

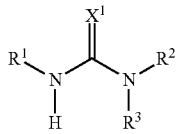

wherein in the general formula (1), $R^1$ is hydrocarbon group of carbon number 1~30 or functional hydrocarbon group of carbon number 1~30; $R^2$ and $R^3$ are respectively hydrocarbon group of carbon number 1~30, functional hydrocarbon group of carbon number 1~30 or hydrogen; $X^1$ is oxygen or sulfur;

(2)

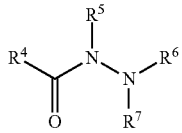

wherein in the general formula (2), $R^4$ is hydrocarbon group of carbon number 1~30 or functional hydrocarbon group of carbon number 1~30; $R^5$~$R^7$ are respectively hydrocarbon group of carbon number 1~30, functional hydrocarbon group of carbon number 1~30 or hydrogen;

(5)

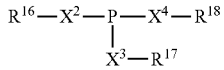

wherein in the formula (5), $X^2$, $X^3$, and $X^4$ respectively indicate oxygen atom or sulfur atom; $R^{16}$, $R^{17}$, and $R^{18}$ respectively indicate hydrogen atom or hydrocarbon group of carbon number 1~30;

(6)

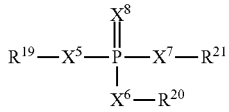

wherein in the formula (6), all of $X^5$~$X^8$ are oxygen atom (one or two of $X^5$, $X^6$, and $X^7$ may be chain of single bond or (poly) oxyalkylene group; and $R^{19}$, $R^{20}$, and $R^{21}$ respectively indicate hydrogen atom or hydrocarbon group of carbon number 1~30.

2. A lubricating oil composition comprising a lubricant base oil containing a base oil (X) of which % $C_p$ is 70~97, % $C_A$ is 1 or less, % $C_N$ is 3~30, % $C_P$/% $C_N$ is 4 or more viscosity index is 115 or more, NOACK evaporation is 8~16 mass %, and CCS viscosity at −35° C. is 3000 mPa·s or less, wherein said lubricant base oil, to total mass of the composition, contains following components (A)~(D):

(A1) 0.005~0.2 mass % of at least one of molybdenum friction modifier selected from molybdenum dithiophosphate and molybdenum dithiocarbamate as molybdenum content;

(B) 0.01~0.2 mass % of phosphorus-containing anti-wear agent as phosphorous content;

(C') 0.01~1 mass % of metallic detergent which at least contains (C1) sulfonate detergent and of which metal ratio is prepared to become 3.0 or more as metal content; and (D) 0.01~0.4 mass % of ashless dispersant having 3000~20000 of weight-average molecular weight as nitrogen content, and wherein said (B) component is one compound selected from the group consisting of: phosphorus compound represented by the following general formula (5), phosphorus compound represented by the following general formula (6), metal salts thereof, amine salts thereof, and derivatives thereof:

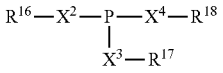

(5)

wherein in the formula (5), $X^2$, $X^3$, and $X^4$ respectively indicate oxygen atom or sulfur atom; $R^{16}$, $R^{17}$, and $R^{18}$ respectively indicate hydrogen atom or hydrocarbon group of carbon number 1~30;

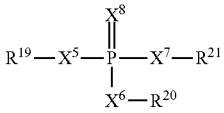

(6)

wherein in the formula (6), all of $X^5$~$X^8$ are oxygen atom (one or two of $X^5$, $X^6$, and $X^7$ may be chain of single bond or (poly) oxyalkylene group); $R^{19}$, $R^{20}$, and $R^{21}$ respectively indicate hydrogen atom or hydrocarbon group of carbon number 1~30.

3. The lubricating oil composition according to claim 1, wherein said (A) component is one or more compound selected from the group consisting of: compounds containing nitrogen represented by the following general formulas (1) and (2), and acid modification derivatives thereof;

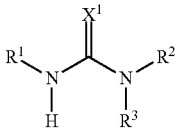

(1)

wherein in the general formula (1), $R^1$ is hydrocarbon group of carbon number 1~30 or functional hydrocarbon group of carbon number 1~30; $R^2$ and $R^3$ are respectively hydrocarbon group of carbon number 1~30, functional hydrocarbon group of carbon number 1~30 or hydrogen; $X^1$ is oxygen or sulfur;

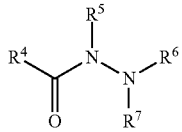

(2)

wherein in the general formula (2), $R^4$ is hydrocarbon group of carbon number 1~30 or functional hydrocarbon group of carbon number 1~30; $R^5$~$R^7$ are respectively hydrocarbon group of carbon number 1~30, functional hydrocarbon group of carbon number 1~30 or hydrogen.

4. The lubricating oil composition according to claim 1 or 3, wherein 0.001~0.2 mass % of organomolybdenum compound (E2) other than molybdenum dithiocarbamate and molybdenum dithiophosphate, to total mass of composition, is contained as molybdenum content.

5. The lubricating oil composition according to claim 2, wherein said (C') component contains: (C1a) sulfonate detergent of which metal ratio is less than 2 and/or (C2a) phenate detergent of which metal ratio is less than 2; and (C1b) sulfonate detergent of which metal ratio is 6.0 or more.

6. The lubricating oil composition according to claim 1 or 2, wherein kinematic viscosity of said base oil (X) at 100° C. is 3.5 $mm^2$ is or more and CCS viscosity of said base oil (X) at −35° C. is 2000 mPa·s or less.

7. The lubricating oil composition according to claim 1 or 2, wherein said lubricant base oil further contains base oil (Ya) of which CCS viscosity at −35° C. is over 3000 mPa·s, viscosity index is 80 or more, % $C_P$ is 60 or more, % $C_A$ is 10 or less, and kinematic viscosity at 100° C. is 5 $mm^2/s$ or more.

8. The lubricating oil composition according to claim 1 or 2, wherein said (D) component contains (D1) ashless dispersant of which weight-average molecular weight is 6500 or more and/or (D2) boron-containing ashless dispersant of which weight-average molecular weight is 3000 or more.

9. The lubricating oil composition according to claim 1 or 2 being used for diesel engine or direct-injection gasoline engine.

* * * * *